US011063337B2

(12) United States Patent
Oxford et al.

(10) Patent No.: US 11,063,337 B2
(45) **Date of Patent: *Jul. 13, 2021**

(54) MULTIPLE-ASSEMBLY ANTENNA POSITIONER WITH ECCENTRIC SHAFT

(71) Applicant: ViaSat, Inc., Carlsbad, CA (US)

(72) Inventors: Thaddeus Dylan Oxford, Decatur, GA (US); Kurt A. Zimmerman, Dunwoody, GA (US)

(73) Assignee: Viasat, Inc., Carlsbad, CA (US)

( * ) Notice: Subject to any disclaimer, the term of this patent is extended or adjusted under 35 U.S.C. 154(b) by 120 days.

This patent is subject to a terminal disclaimer.

(21) Appl. No.: 16/123,699

(22) Filed: Sep. 6, 2018

(65) Prior Publication Data

US 2019/0020094 A1 Jan. 17, 2019

Related U.S. Application Data

(63) Continuation of application No. 14/856,420, filed on Sep. 16, 2015, now Pat. No. 10,079,424.

(51) Int. Cl.

| | |
|---|---|
| ***H01Q 1/12*** | (2006.01) |
| ***H01Q 3/06*** | (2006.01) |
| ***H01Q 3/08*** | (2006.01) |

(52) U.S. Cl.

CPC ..... *H01Q 1/1257* (2013.01); *H01Q 3/06* (2013.01); *H01Q 3/08* (2013.01); *H01Q 1/125* (2013.01)

(58) Field of Classification Search

USPC ..... 248/371, 393, 394, 395, 398; 343/878, 343/890, 892

See application file for complete search history.

(56) References Cited

U.S. PATENT DOCUMENTS 2,407,310 A * 9/1946 Lundy ..... H01Q 3/08 74/1 R
2,410,666 A * 11/1946 Leck ..... G01S 1/02 342/158

(Continued)

FOREIGN PATENT DOCUMENTS

| | | |
|---|---|---|
| CN | 2629237 | 7/2004 |
| TW | 584318 | 11/2004 |
| WO | WO 0017955 | 3/2000 |

OTHER PUBLICATIONS

Bringham Young University, Antenna Sub-Reflector Dithering, 2012, 1 pg.

*Primary Examiner* — Alfred J Wujciak
(74) *Attorney, Agent, or Firm* — Holland & Hart LLP

(57) ABSTRACT

Methods, systems, and devices are described for an antenna positioning apparatus, which includes a multiple-assembly positioner for adjusting a positioning angle about a positioning axis. The multiple-assembly positioner has two or more positioning assemblies that are coupled in series between a base structure and a positioning structure. Positioning assemblies can be individually selected based on various criteria, such as cost, complexity, angular range, and other performance, and be configured to work together to provide a desired range of adjustment to the positioning angle while simultaneously meeting precision requirements. In one example, a positioning assembly can include a shaft with an eccentric portion, which is rotated in order to provide the adjustment. A method is described where a first positioning assembly can be actuated to a first initial position, and then held, such that a second positioning assembly can be actuated to provide a selected antenna positioning angle.

18 Claims, 15 Drawing Sheets

(56) References Cited

U.S. PATENT DOCUMENTS

| | | | | | |
|---|---|---|---|---|---|
| 2,410,831 | A * | 11/1946 | Maybarduk | H01Q 3/08 342/74 |
| 2,552,566 | A * | 5/1951 | Levine | H01Q 3/08 318/67 |
| 2,945,229 | A * | 7/1960 | Klauser | H01Q 3/18 343/754 |
| 2,969,540 | A * | 1/1961 | Clyde | G01S 3/56 342/425 |
| 4,257,048 | A * | 3/1981 | Yokoi | H01Q 1/34 342/372 |
| 4,598,297 | A | 7/1986 | Hawkins | |
| 4,626,864 | A | 12/1986 | Micklethwaite | |
| 4,771,293 | A * | 9/1988 | Williams | H01Q 1/08 343/757 |
| 4,841,309 | A | 6/1989 | Burr | |
| 6,932,307 | B2 | 8/2005 | Guennec et al. | |
| 7,164,391 | B2 | 1/2007 | Lin et al. | |
| 7,388,551 | B2 | 6/2008 | Guidon et al. | |
| 7,439,930 | B2 | 10/2008 | Bury | |
| 7,439,931 | B1 | 10/2008 | Fan | |
| 8,009,116 | B2 | 8/2011 | Peichl et al. | |
| 8,274,441 | B2 | 9/2012 | Fruh et al. | |
| 8,736,512 | B2 | 5/2014 | Grice et al. | |
| 10,079,424 | B2 * | 9/2018 | Oxford | H01Q 3/06 |
| 2007/0177064 | A1 | 8/2007 | Lin et al. | |
| 2010/0116962 | A1 | 5/2010 | Lai et al. | |
| 2011/0068989 | A1 | 3/2011 | Bousquet | |
| 2011/0156956 | A1 | 6/2011 | Gribben | |
| 2011/0247679 | A1 | 10/2011 | Sehlef et al. | |

* cited by examiner

MULTIPLE-ASSEMBLY ANTENNA POSITIONER WITH ECCENTRIC SHAFT

CROSS REFERENCES

The present application for patent claims the benefit of U.S. patent application Ser. No. 14/856,420 by Oxford, et al., entitled "MULTI-ASSEMBLY ANTENNA POSITIONER WITH ECCENTRIC SHAFT," filed Sep. 16, 2015, assigned to the assignee hereof, and expressly incorporated by reference herein.

BACKGROUND

An antenna positioning system is generally used in a wireless communication system where a particular antenna orientation is required to establish and maintain a communication link with a target device. Target devices can include satellites, planes, ground-based vehicles, stationary ground-based targets and the like.

A positioning system for communication with these target devices may have particular performance requirements. For instance, the positioning system may be required to provide a relatively large angular range. In addition, the wireless communication system may require relatively high positioning accuracy to achieve desired performance, which necessitates a precise and efficient mechanism. Furthermore, a positioning assembly that provides movement about one or more axes may experience gravitational load, wind load, or occasional seismic load, which may produce back-driving of the positioning assembly. If back-driving occurs over a relatively large angular range, such back-driving can be not only an operational hazard, it can also be a safety concern if a failure of a component of the positioning assembly occurs. In addition, resistance to back-driving might dictate that an antenna positioning system has relatively high friction, which may produce challenges in providing precise movement for achieving the desired accuracy.

SUMMARY

Methods, systems, and devices are described for an antenna positioning apparatus including a multiple-assembly antenna positioner for adjusting an antenna positioning angle about a positioning axis. The multiple-assembly positioner can have a base structure and a positioning structure rotatably coupled with the base structure about a positioning axis. The positioning structure can have an angular separation from the base structure defined as a positioning angle, where the positioning angle can correspond to an angular orientation of an antenna fixedly coupled with the positioning structure. The angular orientation of the antenna can refer to an orientation of an antenna boresight with respect to a target device, where the antenna boresight is the direction of maximum gain of the antenna. Therefore, an adjustment of the positioning angle can cause a corresponding adjustment between the antenna boresight and the direction of a target device about the positioning axis.

The adjustment of the positioning angle can be provided by multiple positioning assemblies, such as a first positioning assembly and a second positioning assembly. The first positioning assembly and the second positioning assembly can be coupled with each other, and coupled between the base structure and the positioning structure. For instance, the first positioning assembly can be coupled with the base structure, and the second positioning assembly can be coupled between the first positioning assembly and the positioning structure. Said another way, the first positioning assembly and the second positioning assembly can act in combination to adjust the positioning angle, such as a series configuration. By arranging two positioning assemblies in this manner, each positioning assembly can provide particular operational characteristics, rather than requiring that a single positioning assembly provide all of the required characteristics for positioning about a positioning axis.

For instance, in some examples a first positioning assembly can be characterized as providing a relatively large angular range of the positioning angle in comparison to a second positioning assembly. While providing a relatively large angular range, the first positioning assembly may also have relatively high friction to reduce back-driving, and be more suitable for coarse adjustments to the positioning angle. In some examples, the second positioning assembly may be characterized as having lower friction, higher efficiency, and/or greater precision in order to provide a relatively accurate adjustment to the positioning angle over a smaller angular range. Therefore, the selection criteria for the first positioning assembly can be different than the selection criteria for the second positioning assembly, while the combination of the first positioning assembly and the second assembly work together to provide the positioning requirements of the wireless communication system.

In some examples, the multiple-assembly positioner can have a first positioning assembly that includes a linear actuator, which may be any one or more of a threaded rod and threaded collar, a jack screw, an acme screw, a ball screw, a worm gear and rack gear, a pinion gear and a rack gear, a hydraulic cylinder, a linear motor, a turnbuckle, an axial cam, or the like. In examples where the first positioning assembly is a linear actuator, the linear actuator can be coupled with the base assembly at a first pivot point, and coupled with the second positioning assembly at a second pivot point. The linear actuator can adjust the distance between the first pivot point and the second pivot point, thereby providing a first adjustment to the positioning angle. Any of these assemblies can, for instance, be selected to provide a coarse adjustment to the positioning angle over a relatively large angular range. In some examples, the multiple-assembly positioner can have a second positioning assembly that includes a shaft with an eccentric portion, coupled with the first positioning assembly. The shaft can have, for example, a circular cross-section about a driven axis, and a circular cross section about an eccentric axis. The driven axis and the eccentric axis can be parallel, and separated by an eccentricity distance. By rotating a driven portion of the shaft, the eccentric portion of the shaft can rotate to a different position which can change an angle between the base structure and the positioning structure. Said another way, the rotation of a shaft with an eccentric portion can provide a fine adjustment to the positioning angle over a relatively small angular range.

Further scope of the applicability of the described methods and apparatuses will become apparent from the following detailed description, claims, and drawings. The detailed description and specific examples are given by way of illustration only, since various changes and modifications within the scope of the description will become apparent to those skilled in the art.

BRIEF DESCRIPTION OF THE DRAWINGS

A further understanding of the nature and advantages of various aspects of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The described features generally relate to an antenna positioning apparatus, particularly one including a multiple-assembly antenna positioner to control a position of an antenna about a positioning axis. By providing a positioning angle with the described multiple-assembly positioner, the system can have favorable performance characteristics over a system that relies on a single assembly to provide a positioning angle. The multiple-assembly positioner may include an eccentric drive positioning assembly having a shaft with an eccentric portion.

In various examples, the multiple-assembly positioner is described with an accompanying method in which a first positioning assembly can be actuated to a first position, to provide a first value of a positioning angle. The method can then include holding the first positioning assembly at the first position, which can optionally include the step of actively locking the first positioning assembly. While holding the first positioning assembly, a second positioning assembly can be actuated to provide fine adjustment to antenna positioning. The first positioning assembly can be specifically selected to provide a relatively coarse adjustment over a relatively large angular range of the positioning angle, and the second positioning assembly can be specifically selected to provide precise and efficient adjustment over a relatively small angular range of the positioning angle.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

Figure 1:
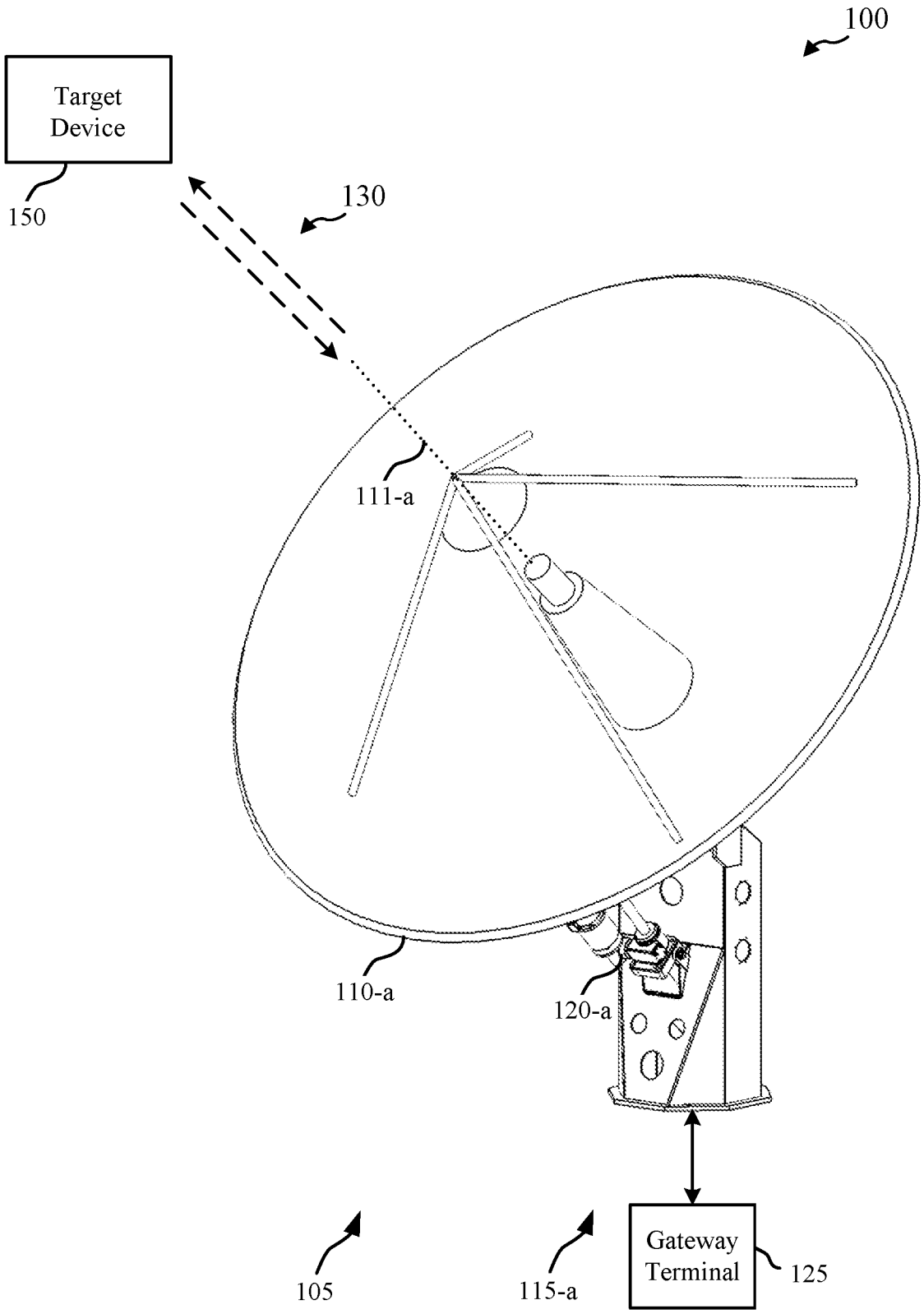
FIG. 1 shows a diagram of a wireless communication system in accordance with various aspects of the present disclosure.

FIG. 1 shows a diagram of a wireless communication system 100 in accordance with various aspects of the present disclosure. The wireless communication system 100 includes an antenna 110-*a* having a boresight 111-*a* (e.g., a direction of highest signal gain for the antenna 110-*a*). In some examples of the wireless communication system 100, it may be desirable to have boresight 111-*a* pointed in a direction corresponding to the location of a target device 150. The target device 150 can be, for example, a satellite following an orbital path (e.g., geostationary orbit, low earth orbit, medium earth orbit, etc.). In other examples, the target device 150 may be an aircraft in flight, a terrestrial target, such as ground-based or water-based vehicle, or a ground-based antenna. The antenna 110-*a* may provide communication with the target device 150 over communication link(s) 130, which can be one-way or two-way communication links. The antenna 110-*a* may be part of a gateway system 105 for a satellite communication system. The gateway system 105 may include gateway terminal 125, which may be in communication with a network (not shown), such as a local area network (LAN), metropolitan area network (MAN), wide area network (WAN), or any other suitable public or private network and may be connected to other communications networks such as the Internet, telephony networks (e.g., Public Switched Telephone Network (PSTN), etc.), and the like.

The orientation of the antenna 110-*a* can be provided by an antenna positioning apparatus 115-*a*, which can adjust the orientation of the antenna 110-*a* about one or more spatial axes, providing, for instance, azimuth (e.g., horizontal) positioning of the antenna 110-*a* or elevation (e.g., vertical) positioning of the antenna 110-*a*. In this manner, the boresight 111-*a* can be directed towards the target device 150 to increase the signal gain along the direction between the antenna 110-*a* and the target device 150. It may be desirable that antenna positioning apparatus 115-*a* provides a relatively large angular range with precise and efficient positioning control.

The selection of a positioning assembly to provide a positioning adjustment for an antenna system can result in a number of performance tradeoffs. For instance, many assemblies that can be favorable for providing a large angular range are not suitable for providing precise adjustment over a small angular range. As an example, a threaded screw, a ball screw, or a rack gear may each be selected to provide a large angular range of adjustment. However, in applications where small, precise movements are required over a small angular range, such an assembly may experience accelerated wear over the small angular range. This can be exacerbated by systems that rely on grease lubrication, where the repetitive motions over a small range can expel grease in the small angular range. Therefore, such systems can be particularly problematic when used repetitively over a small angular range.

A possible improvement to the problems noted above would be to have a low-friction positioning assembly that can provide a large angular range. Such a system could be an improved variation of a threaded screw, a ball screw, or a rack gear, but require improved components, improved materials, improved manufacturing, and/or improved lubrication systems, each of which may impose undue cost, weight, and/or complexity. A hydraulic cylinder or a linear motor may be employed, but may be particularly expensive, and require undesirable support systems. Furthermore, any of the described systems may not be suitable for resisting back-driving, where back-driving is a loss of a desired position due a mechanical load, which can be caused by gravitational loads, wind loads, seismic loads, and the like. In the absence of a relatively high-friction assembly, a positioning assembly may be required to provide a non-trivial nominal force to resist back-driving. However, in the event of system failure, such a nominal force may no longer be available, and back-driving could result in an uncontrolled loss of position. Back-driving over a large angular range may be a safety and/or operational hazard, such that having high friction in a positioning assembly having a large angular range may be desirable to improve the response to external loads. Therefore, low-friction positioning assemblies that can provide a large angular range have other undesirable characteristics.

Described examples of the antenna positioning apparatus 115-*a* can include a multiple-assembly positioner 120-*a*, where multiple positioning assemblies work together to provide a directional adjustment between boresight 111-*a* and the direction of a target device 150 about one of the one or more axes. Each positioning assembly can provide particular characteristics to the multiple assembly positioner while meeting the overall requirements of the antenna positioning apparatus 115-*a*. For example, a first positioning assembly may provide a relatively large angular range, and be generally used for relatively coarse angular positioning. The first positioning assembly may additionally be suitable for resisting back-driving, such as being characterized by having relatively high friction. A second positioning assembly may provide relatively precise and efficient operation, and be used for relatively fine angular positioning. In particular, the second positioning assembly can be configured in a manner that that an adjustment to the positioning angle over a particular angular range uses less energy than an amount of energy used by the first positioning assembly to make a similar adjustment to the positioning angle over the particular angular range. Furthermore, the second positioning assembly may have relatively low static friction, or a relatively small difference between static and dynamic friction, which can facilitate smooth operation and improved positioning control stability. Although the second positioning assembly may not be particularly suitable for resisting back-driving, the severity of an uncontrolled loss of positioning may be mitigated by the second positioning assembly having a relatively small angular range. Thus, the first positioning assembly and the second positioning assembly can each provide particular characteristics to the multiple assembly positioner 120-*a*, while they work in combination to meet the overall requirements of the antenna positioning apparatus 115-*a*.

In particular examples, described in greater detail below, the second positioning assembly can include a shaft with an eccentric portion to provide precise and efficient adjustment to the positioning angle over a relatively small angular range. The shaft can rotate, for example, about a driven axis, and have an eccentric portion comprising an eccentric axis, which can have a circular cross-section. The driven axis and the eccentric axis can be parallel, and separated by an eccentricity distance. By rotating the driven portion of the shaft, the eccentric portion of the shaft can rotate to a different position which can change an angle between the base structure and the positioning structure. Said another way, the rotation of a shaft with an eccentric portion can provide a fine adjustment to the positioning angle of the multiple-assembly positioner. Furthermore, by having a relatively small angular range, the severity of an uncontrolled loss of positioning due to back-driving can be mitigated.

Figure 2A:
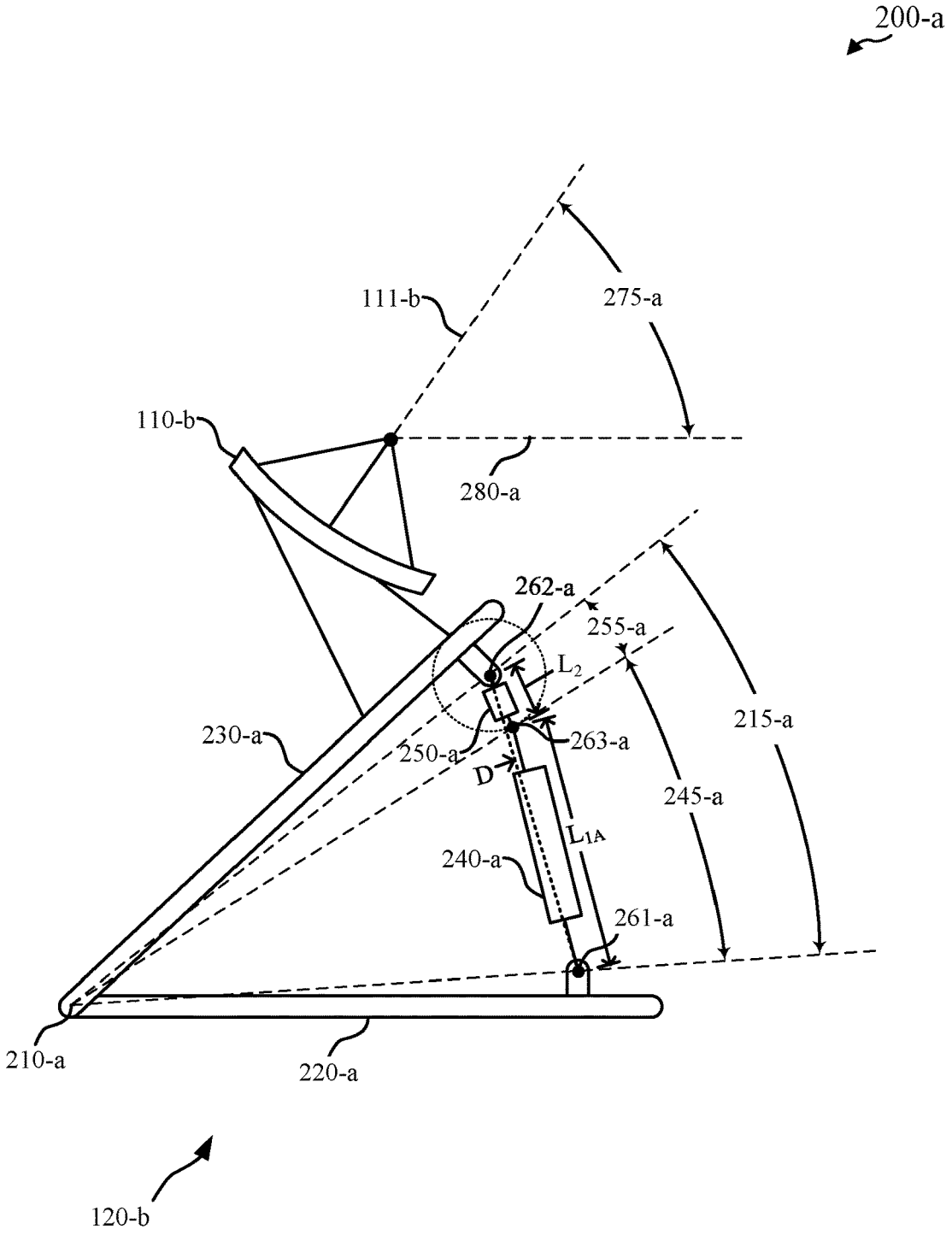
FIGS. 2A-2C show schematic representations of a multiple-assembly positioner in various states of operation in accordance with various aspects of the present disclosure.
Figure 2B:
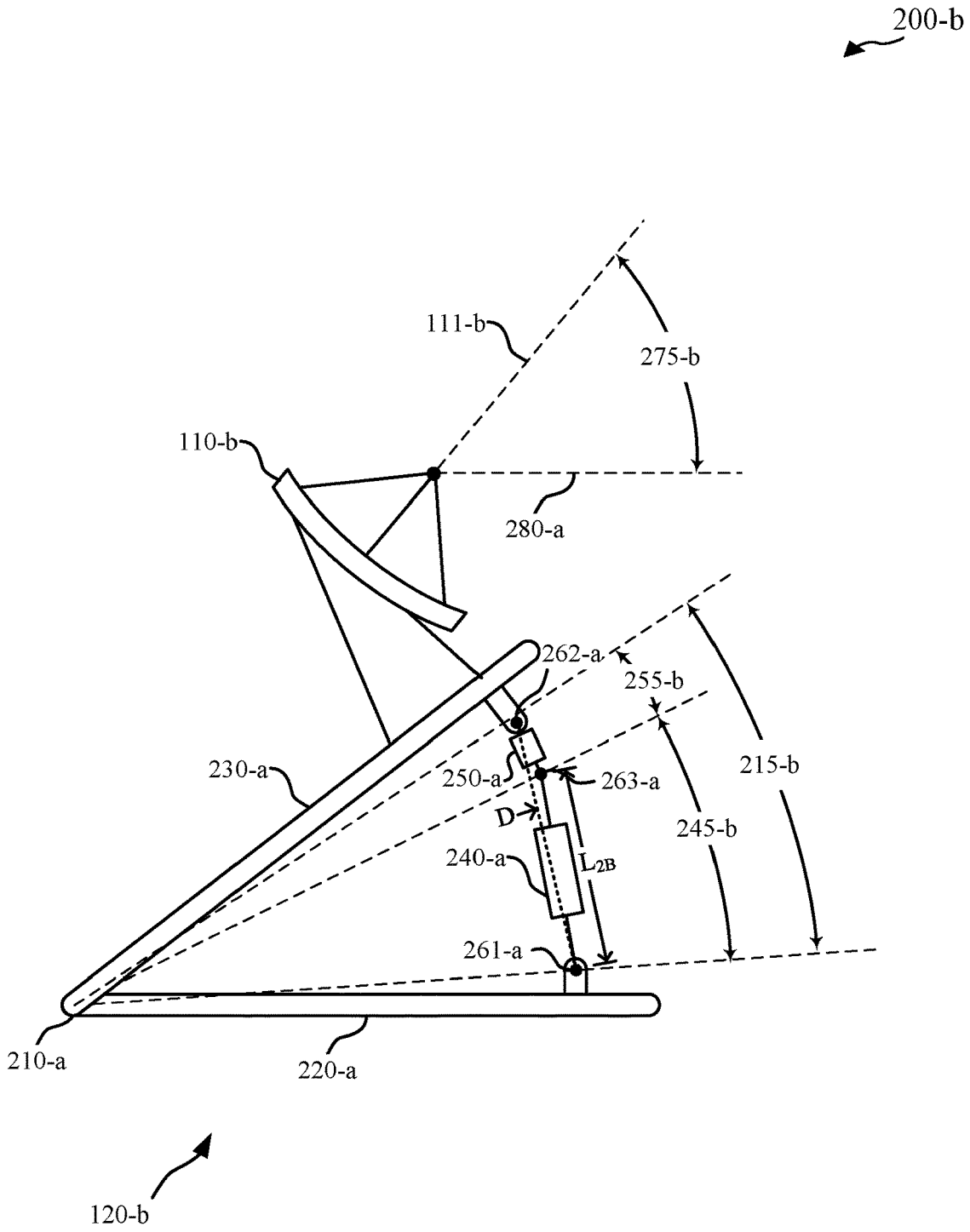
Figure 2C:
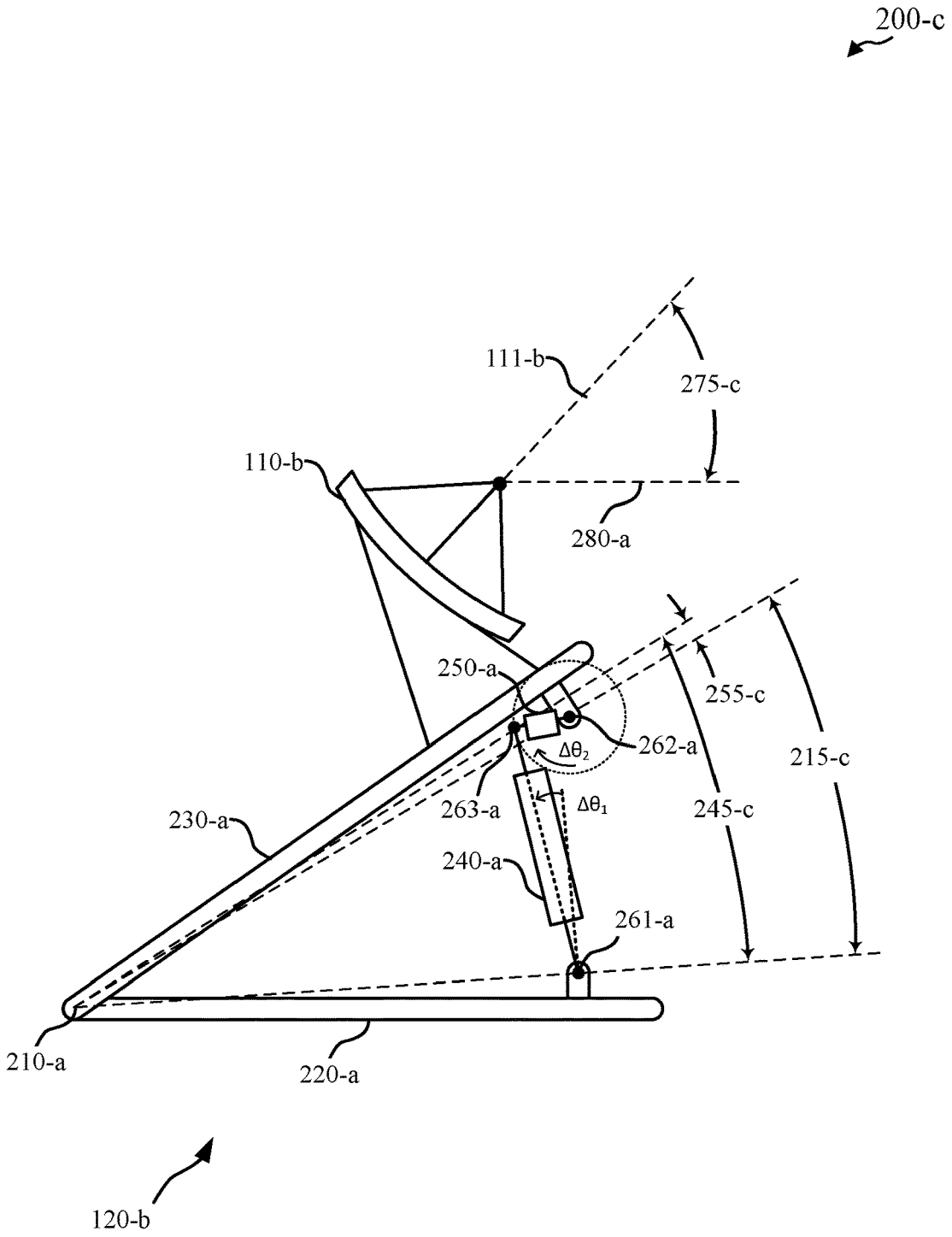

FIGS. 2A-2C show schematic representations of a multiple-assembly positioner 120-*b* in various states of operation in accordance with various aspects of the present disclosure. The multiple-assembly positioner 120-*b* can be an example of multiple-assembly positioner 120-*a* of FIG. 1. The multiple-assembly positioner 120-*b* can have a base structure 220-*a*, and a positioning structure 230-*a*, which are rotatably coupled about a positioning axis 210-*a*. The rotatable coupling provides a degree of rotational freedom between the base structure 220-*a* and the positioning structure 230-*b*, and may include any of a ball bearing, a roller bearing, a journal bearing, a bushing, a spherical bearing, a ball and socket joint, and the like. The base structure 220-*a* can be fixedly coupled to, for instance, the ground, or any other stationary or moving support assembly, where the fixed coupling provides a fixed relationship between structures or objects. In other examples, the base structure 220-*a* can be rotatably coupled to, for instance, the ground, or any other stationary or moving support assembly, where the rotatable coupling may rotate about an axis other than the positioning axis 210-*a* to provide another direction of positioning. The positioning axis 210-*a* can be, for instance, an elevation axis, and the rotatable coupling of the base structure 220-*a* can rotate about an azimuth axis. The positioning structure 230-*a* can be coupled with an antenna 110-*b*, which can be either a fixed coupling, or can be a coupling that allows further positioning, such as a rotational positioning about a second axis (e.g., azimuth axis, etc.).

In an example, FIG. 2A shows a view 200-*a* of a first state of a multiple-assembly positioner 120-*b*. The multiple-assembly positioner 120-*b* has a positioning angle 215-*a*, which represents an angular position of the positioning structure 230-*a* with respect to the base structure 220-*a*, about the positioning axis 210-*a*. Said another way, the positioning angle 215-*a* can be measured as an angular position in the plane of the view 200-*a* about the positioning axis 210-*a*. Although shown as being measured between particular points of the base structure 220-*a* and the positioning structure 230-*a*, the positioning angle 215-*a* can be measured with respect to any reference point of the base structure 220-*a* and/or the positioning structure 230-*a* about the positioning axis 210-*a*.

The multiple-assembly positioner 120-*b* provides an adjustment to the positioning angle 215-*a* which in turn provides an adjustment to a corresponding antenna angle 275-*a*. The corresponding antenna angle 275-*a* can be measured, for instance, as an angle between a projection of the boresight 111-*b* on the plane of the view 200-*a* and any suitable reference such as reference 280. In the illustrated example, where the multiple-assembly positioner 120-*b* provides an adjustment to the corresponding antenna angle 275-*a* in an elevation axis, the positioning axis 210-*a* is in a horizontal direction, and the reference 280 is a horizontal ground plane. However, the multiple-assembly positioner 120-*b* may be configured to provide an adjustment to the corresponding antenna angle 275-*a* along an azimuth axis or cross-elevation axis (e.g., partially in elevation and partially in azimuth), in some cases.

The multiple-assembly positioner 120-*b* includes a first positioning assembly 240-*a*, and a second positioning assembly 250-*a*. The first positioning assembly 240-*a* is coupled with the base structure 220-*a* at first coupling location 261-*a*. The second positioning assembly 250-*a* is coupled with the positioning structure 230-*a* at a second coupling location 262-*a*. The first positioning assembly 240-*a* and the second positioning assembly 250-*a* are coupled with each other at a third coupling location 263-*a*. In various examples, any of the first coupling location 261-*a*, the second coupling location 262-*a*, or the third coupling location 263-*a* can provide either a fixed coupling, or can provide one or more degrees of freedom by way of any suitable component or assembly, such as a rotational degree of freedom by way of a cylindrical joint and/or bearing, a spherical degree of freedom by way of a spherical joint and/or bearing, and/or a linear degree of freedom by way of a linear bearing or sliding bushing. In various examples, any one or more of the first coupling location 261-*a*, the second coupling location 262-*a*, or the third coupling location 263-*a* may be a pivot point.

As shown in the illustrated example, the first positioning assembly 240-*a* is associated with a first portion 245-*a* of the positioning angle 215-*a*, which corresponds to an angular separation between the first coupling location 261-*a* and the third coupling location 263-*a* about the positioning axis 210-*a*. The first portion 245-*a* of the positioning angle 215-*a* is a function of the length $L_1$ (shown in FIG. 2A as $L_{1A}$) of the first positioning assembly 240-*a*. For example, the first portion 245-*a* of the positioning angle 215-*a* may depend on the distances between the positioning axis 210-*a* and the first coupling location 261-*a* and second coupling location 262-*a*, and the component of length $L_1$ in the direction D between the first coupling location 261-*a* and the second coupling location 262-*a*. In some examples the first positioning assembly 240-*a* can be a linear actuator.

The second positioning assembly 250-*a* is associated with a second portion 255-*a* of the positioning angle 215-*a* which corresponds to an angular separation between the second coupling location 262-*a* and the third coupling location 263-*a* about the positioning axis 210-*a*. The second portion 255-*a* of the positioning angle 215-*a* is a function of the length $L_2$ of the second positioning assembly 250-*a* between the second coupling location 262-*a* and the third coupling location 263-*a*. For example, the second portion 255-*a* of the positioning angle 215-*a* may depend on the distances between the positioning axis 210-*a* and the first coupling location 261-*a* and second coupling location 262-*a*, and the component of length $L_2$ in the direction D between the first coupling location 261-*a* and the second coupling location 262-*a*.

The view 200-*b* of multiple-assembly positioner 120-*b* shown in FIG. 2B illustrates the multiple-assembly positioner 120-*b* in a second state where, in comparison to the first state, the length $L_1$ of the first positioning assembly 240-*a* has been reduced from $L_{1A}$ to $L_{1B}$. This has the effect of reducing the first portion 245-*a* of the positioning angle 215-*a*. The reduction in length of the first positioning assembly 240-*a* reduces the positioning angle 215-*a* to a reduced positioning angle 215-*b*, and also reduces the corresponding antenna angle 275-*a* to a reduced antenna angle 275-*b*. As shown in view 200-*b*, the ratio of the length $L_1$ of the first positioning assembly 240-*a* to the component of the length $L_1$ in the direction D between the first coupling location 261-*a* and the second coupling location 262-*a* may change as the length $L_1$ changes, and may depend on the length $L_2$ and rotational angle between the first coupling location 261-*a* and the third coupling location 263-*a*. Thus, the overall change in the positioning angle 215 due to a change in length $L_1$ of the first positioning assembly 240-*a* may be a function of the distances between the positioning axis 210-*a* and the first coupling location 261-*a* and second coupling location 262-*a*, the length $L_1$ of the first positioning assembly 240-*a*, the length $L_2$ of the second positioning assembly 250-*a*, and a rotational angle of the third coupling location 263-*a* relative to the first coupling location 261-*a*.

Inversely, an increase to the positioning angle 215 may be provided by increasing the length of the first positioning assembly 240-*a*. In some examples, the components and/or mechanisms of the first positioning assembly 240-*a* may be selected to provide a relatively large angular range of the first portion 245 of the positioning angle 215, and/or to provide a relatively high resistance to back-driving as previously described. The first positioning assembly 240-*a* may be characterized by the ability to handle relatively large loads while resisting back-driving (e.g., have relatively high inherent friction). For instance, the first positioning assembly 240-*a* may include a linear actuator, which may be any one or more of a threaded rod and threaded collar, a jack screw, an acme screw, a ball screw, a worm gear and rack gear, a pinion gear and a rack gear, a hydraulic cylinder, a linear motor, a turnbuckle, an axial cam, or the like.

In some embodiments, the second positioning assembly 250-*a* may adjust the second portion 255-*a* of the positioning angle 215-*a* by rotating the second coupling location 262-*a* and the third coupling location 263-*a* relative to each other while keeping the length $L_2$ constant. The view 200-*c* of multiple-assembly positioner 120-*b* shown in FIG. 2C illustrates the multiple-assembly positioner 120-*b* in a third state where the second positioning assembly 250-*a* has been actuated to adjust the positioning angle 215 relative to the first state. Specifically, in the third state shown in view 200-*c*, the second positioning assembly 250-*a* has been actuated to rotate the third coupling location 263-*a* about the second coupling location 262-*a* by a rotation angle $\Delta\theta_1$. View 200-*c* thus shows that the distance between the first coupling location 261-*a* and the second coupling location 262-*a* has been reduced without reducing the length $L_2$ between the second coupling location 262-*a* and the third coupling location 263-*a*.

As shown in view 200-*c*, the actuation of the second positioning assembly 250-*a* has reduced the positioning angle 215-*a* of the multiple-assembly positioner 120-*b* in the first state to the positioning angle 215-*c*. The second portion 255-*c* of the positioning angle 215-*c* shown in view 200-*c* is a negative angular value, which subtracts from the first portion 245-*c* of the positioning angle 215-*c* to provide the positioning angle 215-*c*. It can be understood that the second positioning assembly 250-*a* can provide either positive or negative angular values for the second portion 255 of the positioning angle 215 by rotation of the third coupling location 263-*a* to a suitable position on the illustrated circle about the second coupling location 262-*a*. The described reduction of the positioning angle 215-*a* to the positioning angle 215-*c* using the second positioning assembly 250-*a* provides a reduction to the antenna angle 275-*a* shown in FIG. 2A to a reduced antenna angle 275-*c*.

In some examples, a rotation of the third coupling location 263-*a* relative to the second coupling location 262-*a* by actuation of second positioning assembly 250-*a* may cause and/or require a corresponding rotation of the first positioning assembly 240-*a*, which may change the first portion 245 of the positioning angle 215. This effect may be based at least in part on limited degrees of freedom in the system as dictated by the particular kinematic relationships between components of the multiple-assembly positioner 120-*b*. In the present example, a rotation of the second positioning assembly 250-*a* by a rotation $\Delta\theta_2$ is accompanied by a rotation $\Delta\theta_1$ of the first positioning assembly 240-*a*. The rotation $\Delta\theta_1$ of the first positioning assembly 240-*a* may be a passive rotation (e.g., not explicitly controlled), and may be required in some examples to prevent an over-constrained mechanical system. Thus, the overall change in the positioning angle 215 due to rotation of the third coupling location 263-*a* relative to the second coupling location 262-*a* by actuation of second positioning assembly 250-*a* may be a function of the distances between the positioning axis 210-*a* and the first coupling location 261-*a* and second coupling location 262-*a*, the length $L_1$ of the first positioning assembly 240-*a*, the length $L_2$ of the second positioning assembly 250-*a*, and the rotational angle $\theta_2$ of the third coupling location 263-*a* relative to the second coupling location 262-*a*.

In some examples, the second positioning assembly 250-*a* may be an eccentric drive positioning assembly having a shaft with a driven portion and an eccentric portion. The eccentric drive positioning assembly may provide a relatively precise and efficient operation over a relatively small angular range of the second portion 255 of the positioning angle 215. The second coupling location 262-*a* can include a rotational coupling about an axis of the driven portion of the shaft such as a first bearing or bushing, and the third coupling location 263-*a* can include a rotational coupling about the axis of the eccentric portion of the shaft such as a second bearing or bushing. Thus, the distance between the axis of the driven portion and the axis of the eccentric portion (e.g., eccentricity of the shaft) can determine the distance between the second coupling location 262-*a* and the third coupling location 263-*a*, while the second portion 255 of the positioning angle 215 provided by the eccentric drive positioning assembly may be determined by the rotation of the shaft. In various other examples, the axis of the driven portion of the shaft can be located at the third coupling location 263-*a*, and the axis of the eccentric portion of the shaft can be located at the second coupling location 262-*a*.

Although the example illustrated in FIGS. 2A-2C shows the second positioning assembly 250-*a* coupled between the first positioning assembly 240-*a* and the positioning structure, it should be understood that the second positioning assembly 250-*a* may be coupled between the base structure 220-*a* and the first positioning assembly 240-*a*, in other examples.

Figure 3A:
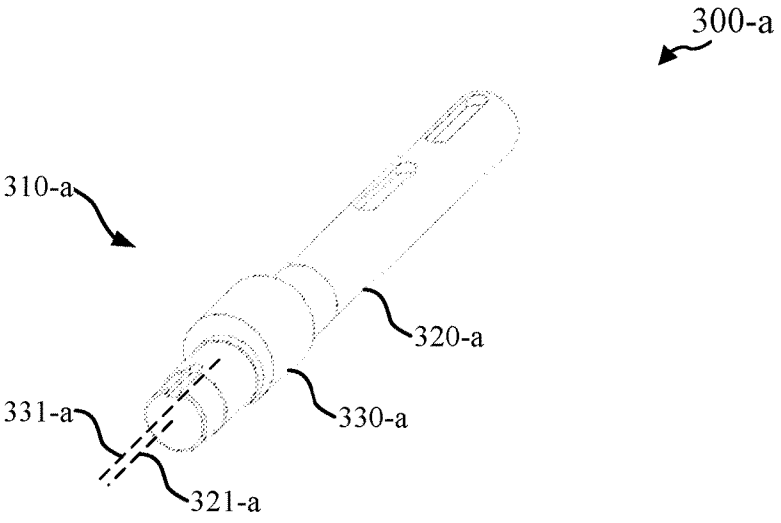
FIGS. 3A-3C show views of a shaft with an eccentric portion in accordance with various aspects of the present disclosure.
Figure 3B:
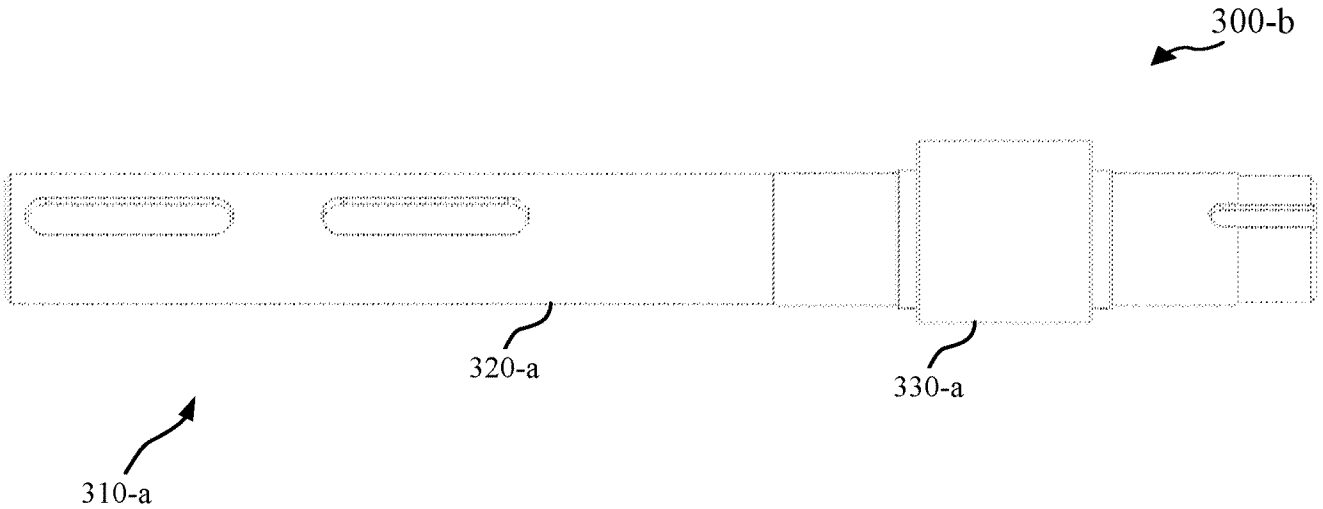
Figure 3C:
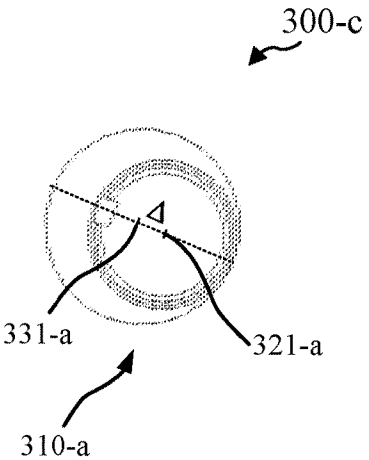

FIGS. 3A-3C show views of a shaft 310-*a* with an eccentric portion in accordance with various aspects of the present disclosure. The shaft 310-*a* may be employed in an eccentric drive positioning assembly which may be, for example, the second positioning assembly 250-*a* described in reference to FIGS. 2A-2C.

The shaft 310-*a* has a driven portion 320-*a* with a driven portion axis 321-*a*, and an eccentric portion 330-*a* with an eccentric portion axis 331-*a*. In the illustrated example, the driven portion axis 321-*a* and the eccentric portion axis 331-*a* are parallel, and separated by an eccentricity distance Δ as shown in view 300-*c* of FIG. 3C. Furthermore, as shown in the illustrated example, the driven portion 320-*a* and/or the eccentric portion 330-*a* has a circular cross-section. Thus, an eccentric drive positioning assembly can provide a rotation of the eccentric portion axis 331-*a* around the driven portion axis 321-*a* as the shaft 310-*a* is rotated.

Referring back to FIGS. 2A-2C, the driven portion 320-*a* can be rotatably coupled with the positioning structure 230-*a* at the second coupling location 262-*a* of the multiple-assembly positioner 120-*b*, and the eccentric portion 330-*a* can be rotatably coupled with the first positioning assembly at the third coupling location 263-*a* of the multiple-assembly positioner 120-*b*. Rotation of the driven portion 320-*a* can be provided by any suitable mechanism coupled with the driven portion 320-*a*, such as an electric motor, a gear motor, a hydraulic motor, and the like. Therefore, as will be shown in greater detail, the rotation of a shaft having an eccentric portion can provide an adjustment to the positioning angle 215, and thus provide an adjustment to the corresponding antenna angle 275.

FIGS. 4A-4D show schematic views of a second positioning assembly 250-*b*, which is an example of an eccentric drive positioning assembly in accordance with various aspects of the present disclosure. Second positioning assembly 250-*b* includes a shaft 310-*b* having a driven portion 320-*b* and an eccentric portion 330-*b*. In the illustrated example, the driven portion 320-*b* is rotatably coupled with a first positioning assembly 240-*b*, and the eccentric portion 330-*b* is rotatably coupled with a positioning structure 230-*b*. In other examples, a driven portion 320-*b* may be rotatably coupled with the positioning structure 230-*b*, and an eccentric portion 330-*b* may be rotatably coupled with the first positioning assembly 240-*b*.

Figures 4A, 4B, 4C, 4D:
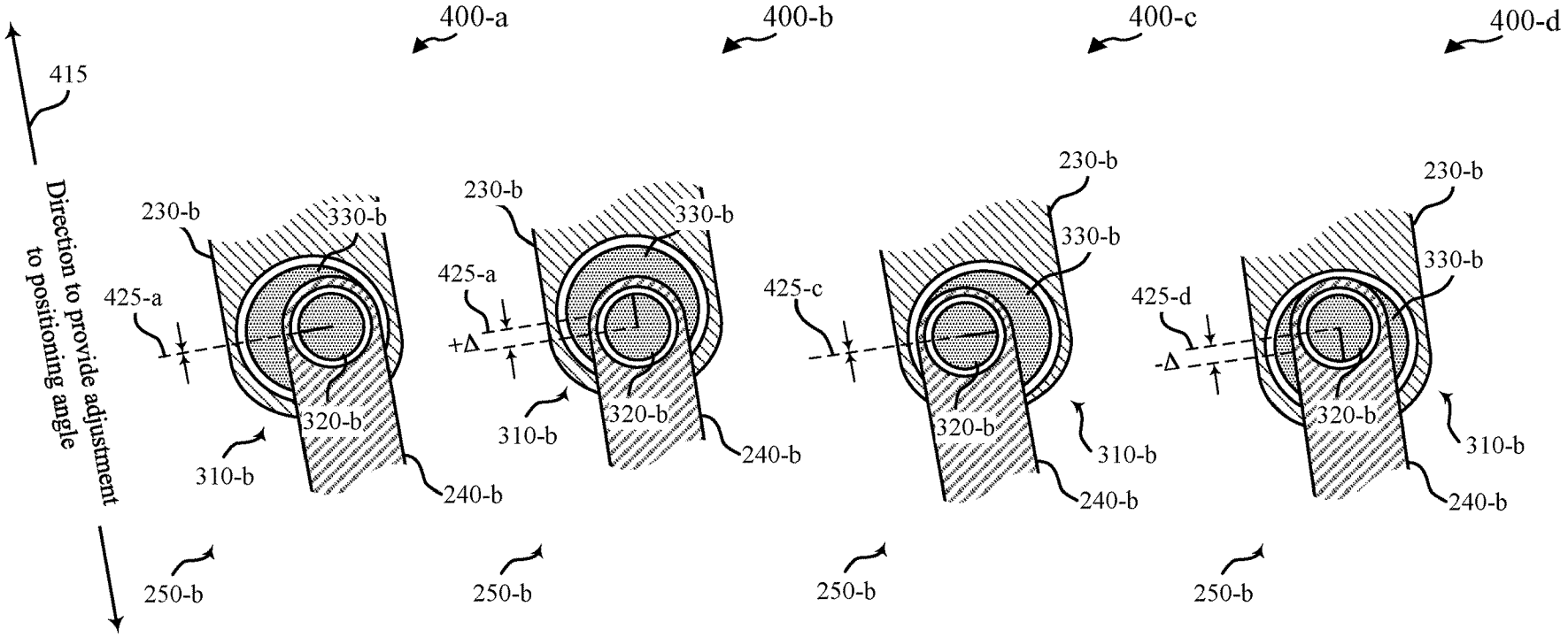
FIGS. 4A-4D show schematic views of an eccentric drive positioning assembly in accordance with various aspects of the present disclosure.

A first position of the second positioning assembly 250-*b* is shown in view 400-*a* of FIG. 4A. In the first position, the angular position of the shaft 310-*b*, as indicated by the orientation of the solid line within the driven portion 320-*b*, corresponds to the eccentric portion 330-*b* not being offset from the driven portion 320-*b* in the positioning angle direction 415. That is, the eccentric portion 330-*b* is offset from the driven portion 320-*b* in a direction perpendicular to the positioning angle direction 415 when the shaft 310-*b* is in the first position. Therefore, in the first position, a positioning distance 425-*a* provided by the second positioning assembly 250-*b* may be zero, which may correspond to the second portion 255 of the positioning angle 215 as shown in FIGS. 2A-2C also having an angular value of zero degrees.

A second position of the second positioning assembly 250-*b* is shown in view 400-*b* of FIG. 4B. The second position can represent a rotation of the shaft 310-*b* from the first position of FIG. 4A by approximately 90 degrees in a clockwise direction, as indicated by the orientation of the solid line within the driven portion 320-*b*. As shown in the illustrated example, this angular position of the second positioning assembly 250-*b* may correspond to a position where the eccentric portion 330-*b* is offset in a positive direction from the driven portion 320-*b* in the positioning angle direction 415. In the second position, the positioning distance 425-*b*, as measured in the positioning angle direction 415, can be equal to the separation distance between the driven portion 320-*b* and the eccentric portion 330-*b*, noted again as Δ. Therefore, the second portion 255 of the positioning angle 215 as shown in FIGS. 2A-2C can be a maximum at a rotation of the shaft 310-*b* approximately equal to 90 degrees in a clockwise direction from the first position.

A third position of the second positioning assembly 250-*b* is shown in view 400-*c* of FIG. 4C. The third position can represent a rotation of the shaft 310-*b* from the first position of FIG. 4A of approximately 180 degrees in a clockwise direction, as indicated by the orientation of the solid line within the driven portion 320-*b*. As shown in the illustrated example, the eccentric portion 330-*b* is offset from the driven portion 320-*b* in a direction generally perpendicular to the positioning angle direction 415. Therefore, the positioning distance 425-*c* of the second positioning assembly 250-*b* in the third position may also be zero.

A fourth position of the second positioning assembly 250-*b* is shown in view 400-*d* of FIG. 4D. The fourth position can represent a rotation of the shaft 310-*b* from the nominal position of FIG. 4A of approximately 270 degrees in a clockwise direction, as indicated by the orientation of the solid line within the driven portion 320-*b*. As shown in the illustrated example, this angular position of the second positioning assembly 250-*b* may correspond to a position where the eccentric portion 330-*b* is offset in a negative direction from the driven portion 320-*b* in positioning angle direction 415. For example, the fourth position may provide a minimum (e.g., maximum negative angular value) positioning distance 425-*d* of −Δ. Thus, the fourth position corresponds to a negative value of the second portion 255 of the positioning angle 215 as shown in FIGS. 2A-2C.

In each of FIGS. 4A-4D, the first positioning assembly 240-*b* and the positioning structure 230-*b* are shown in the same angular orientation. However, in various examples of multiple-assembly positioners, at least one of the first positioning assembly 240-*b* and the positioning structure 230-*b* can have an additional rotational component. For instance, the kinematic relationships of a multiple-assembly positioner 120 may dictate that, for the second positioning assembly 250-*b* having a shaft with an eccentric portion, the first positioning assembly 240-*b* must have a rotational degree of freedom. This rotational degree of freedom may be simply provided by, for instance, a bearing at a first coupling location (e.g., first coupling location 261-*a* shown in FIGS. 2A-2C). Thus, while the angular rotations of the shaft 310-*b* described with reference to FIGS. 4A-4D are discussed as approximate, the actual rotation of the shaft 310-*b* between positions providing a second portion of the positioning angle equal to zero and the maximum and minimum angular values depend on the angular relationship between the first positioning assembly 240-*b* and the positioning structure 230-*b*, which may depend on the positioning axis and the coupling locations. Generally, the angular rotation of the shaft 310-*b* between the positions illustrated in FIGS. 4A-4D, relative to the positioning angle direction 415, may be determined based at least in part on the length of the first positioning assembly 240-*b* and the separation distance Δ between the driven portion 320-*b* and the eccentric portion 330-*b*.

Furthermore, as the length of the first positioning assembly 240-*b* changes, the positioning angle direction 415 changes. Thus, the second portion of the positioning angle as shown in FIGS. 2A-2C provided by the second and fourth positions of the shaft 310-*b* varies with the length of the first positioning assembly 240-*b*. For instance, the second portion of the positioning angle as shown in FIGS. 2A-2C provides a first angular value for a first length of the first positioning assembly 240-*b* for the second position of the shaft 310-*b*. For a different length of the first positioning assembly 240-*b*, the second portion of the positioning angle as shown in FIGS. 2A-2C provides a second, different angular value for the second position of the shaft 310-*b*.

Figure 5:
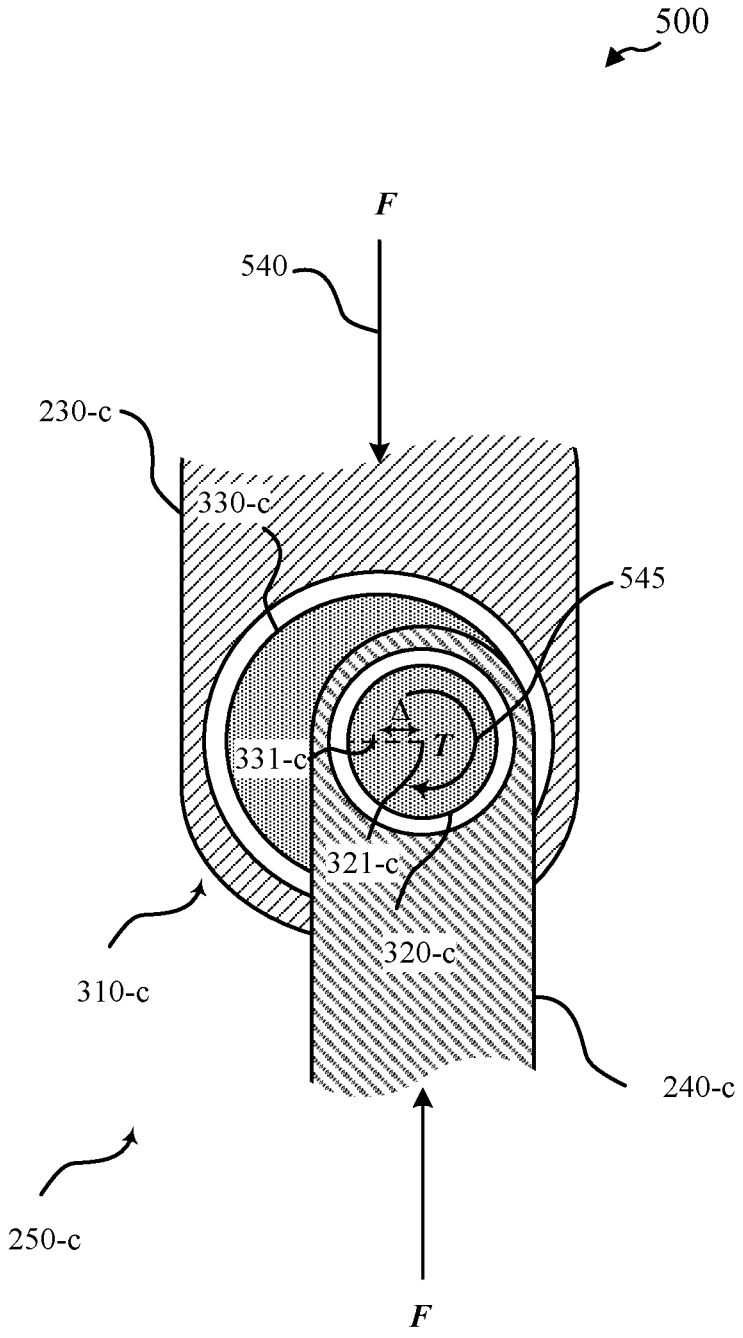
FIG. 5 shows a schematic view of an eccentric drive positioning assembly in accordance with various aspects of the present disclosure.

FIG. 5 shows a schematic view 500 of a second positioning assembly 250-*c* in accordance with various aspects of the present disclosure. As shown in view 500, the second positioning assembly 250-*c* includes a shaft 310-*c* having a driven portion 320-*c* with a driven portion axis 321-*c*, and an eccentric portion 330-*c* with an eccentric portion axis 331-*c*. The driven portion axis 321-*c* and the eccentric portion axis 331-*c* are parallel, and separated by a distance Δ, where the distance Δ is related to the angular range of an adjustment to a positioning angle by the second positioning assembly 250-*c* (e.g., a larger distance Δ provides a greater angular range). In the illustrated example, the driven portion 320-*c* is rotatably coupled to a first positioning assembly 240-*c*, and the eccentric portion 330-*c* is rotatably coupled to a positioning structure 230-*c*. The position of the second positioning assembly 250-*c* in the view 500 can represent a nominal position, wherein the angular position of the shaft 310-*c*, noted by the dashed line, corresponds to the first position of the second positioning assembly 250-*b* described in reference to FIG. 4A.

In the position of the second positioning assembly 250-*c* illustrated in view 500, a load F 540 is applied through the second positioning assembly 250-*c*. The load F 540 can be any externally-applied load, which may be a dynamic load corresponding to an actuation of the first positioning assembly 240-*c* and/or the second positioning assembly 250-*c*, or some other load such as a gravitational load, a wind load, a seismic load, and the like. Although load F 540 is shown as a force for simplicity, it should be noted that the load F 540 may be a combination of an applied force and/or an applied torque. As shown in the illustrated example, a torque T 545 is applied to the shaft's driven portion 320-*c* in order for the second positioning assembly 250-*c* to provide a dynamic adjustment to a positioning angle, or to remain in static equilibrium. The magnitude of torque T 545 is related to the magnitude of force F 540 and a moment arm measured as the projected distance between the driven portion axis 321-*c* and the eccentric portion axis 331-*c* in a direction perpendicular to the applied force, which is related to the distance Δ. Therefore, in the design of the second positioning assembly 250-*c*, there is a tradeoff between angular range and drive device design. Specifically, as the angular range of the second positioning assembly increases, so does the magnitude of torque required to provide an adjustment to a positioning angle and/or maintain static equilibrium.

In the position shown in view 500, the magnitude of torque T 545 to counteract the applied force F 540 is relatively high, as the offset Δ between the driven portion axis 321-*c* and the eccentric portion axis is aligned perpendicular to the direction of applied force F 540. In some instances, the eccentric portion 330-*c* can be offset from the driven portion 320-*c* in a direction parallel to the applied force F 540 (e.g., the second and fourth positions described in reference to FIGS. 4B and 4D, respectively). In these instances, a torque applied to maintain static equilibrium may be a minimum, or even zero. Therefore, even if an externally applied force is constant, the torque required to provide an adjustment to a positioning angle, or to maintain static equilibrium can change based on the angular position of the second positioning assembly 250-*c*. As such, it can be important to consider the angular position of the second positioning assembly 250-*c* when designing and operating a drive mechanism to apply the torque T 545 to make an adjustment to a positioning angle and/or to maintain static equilibrium.

FIGS. 6A-6D show views of an antenna system 605 employing a multiple-assembly antenna positioner in accordance with various aspects of the present disclosure. The antenna system 605 includes antenna 110-*c* with a boresight 111-*c* and antenna positioning apparatus 115-*b*. Antenna positioning apparatus 115-*b* includes multiple-assembly positioner 120-*c*, which may be an example of multiple-assembly positioners 120 described in reference to FIG. 1 or 2A-2C. The multiple-assembly positioner 120-*c* can provide an angular adjustment between a base structure 220-*d* and a positioning structure 230-*d*, about a positioning axis 210-*b*. Therefore, the multiple-assembly positioner 120-*c* can provide an angular adjustment between the boresight 111-*c* and the direction of a target device.

Figure 6A:
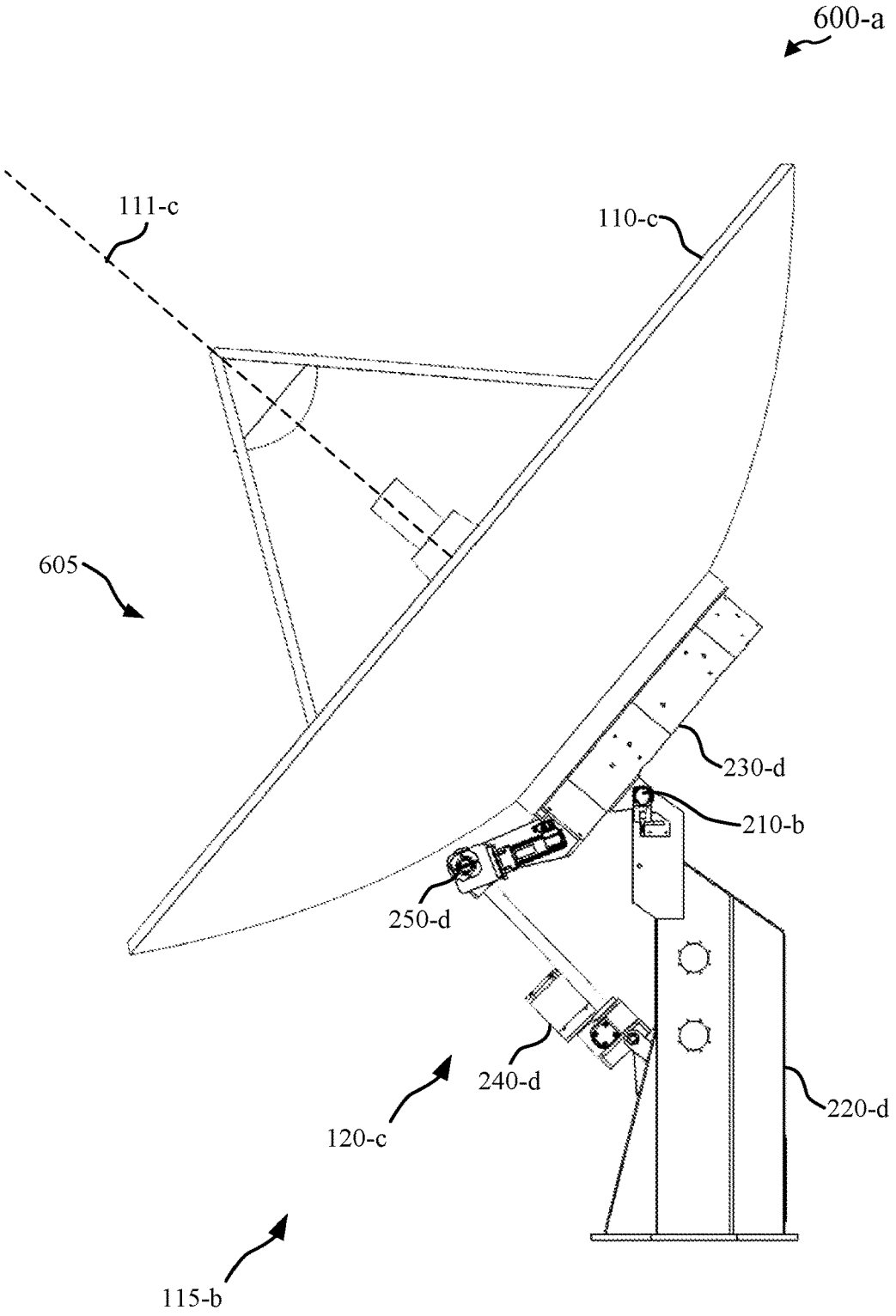
FIGS. 6A-6D show views of an antenna system employing a multiple-assembly antenna positioner in accordance with various aspects of the present disclosure.

View 600-*a* of FIG. 6A highlights the various relevant components of the antenna system 605. The multiple-assembly positioner 120-*c* includes a first positioning assembly 240-*d*, and a second positioning assembly 250-*d*. The first positioning assembly 240-*d* can be adjusted in a manner that changes the length of the first positioning assembly 240-*d*, such as the change in length of the first positioning assembly 240-*a* described in reference to FIGS. 2A and 2B. For instance, the first positioning assembly 240-*d* can be a linear actuator.

The first positioning assembly 240-*d* may be suitable for providing a wide angular range (e.g., greater than 45 degrees, approximately 90 degrees, etc.) while resisting back-driving. The second positioning assembly 250-*d* can be suitable for providing precise and efficient operation over a relative small angular range (e.g., less than 5 degrees, less than 2 degrees, less than 1 degree, less than 0.5 degree, etc.). Thus, the ratio of the angular range provided by the first positioning assembly 240-*d* to the angular range provided by the second positioning assembly 250-*d* can be greater than 5, greater than 10, greater than 20, or greater than 50, in some cases. In the illustrated example, the first positioning assembly 240-*d* includes a jack screw, and the second positioning assembly 250-*d* includes an shaft with an eccentric portion, such as shafts 310 described in reference to FIG. 3A-3C, 4A-4D, or 5.

Figure 6B:
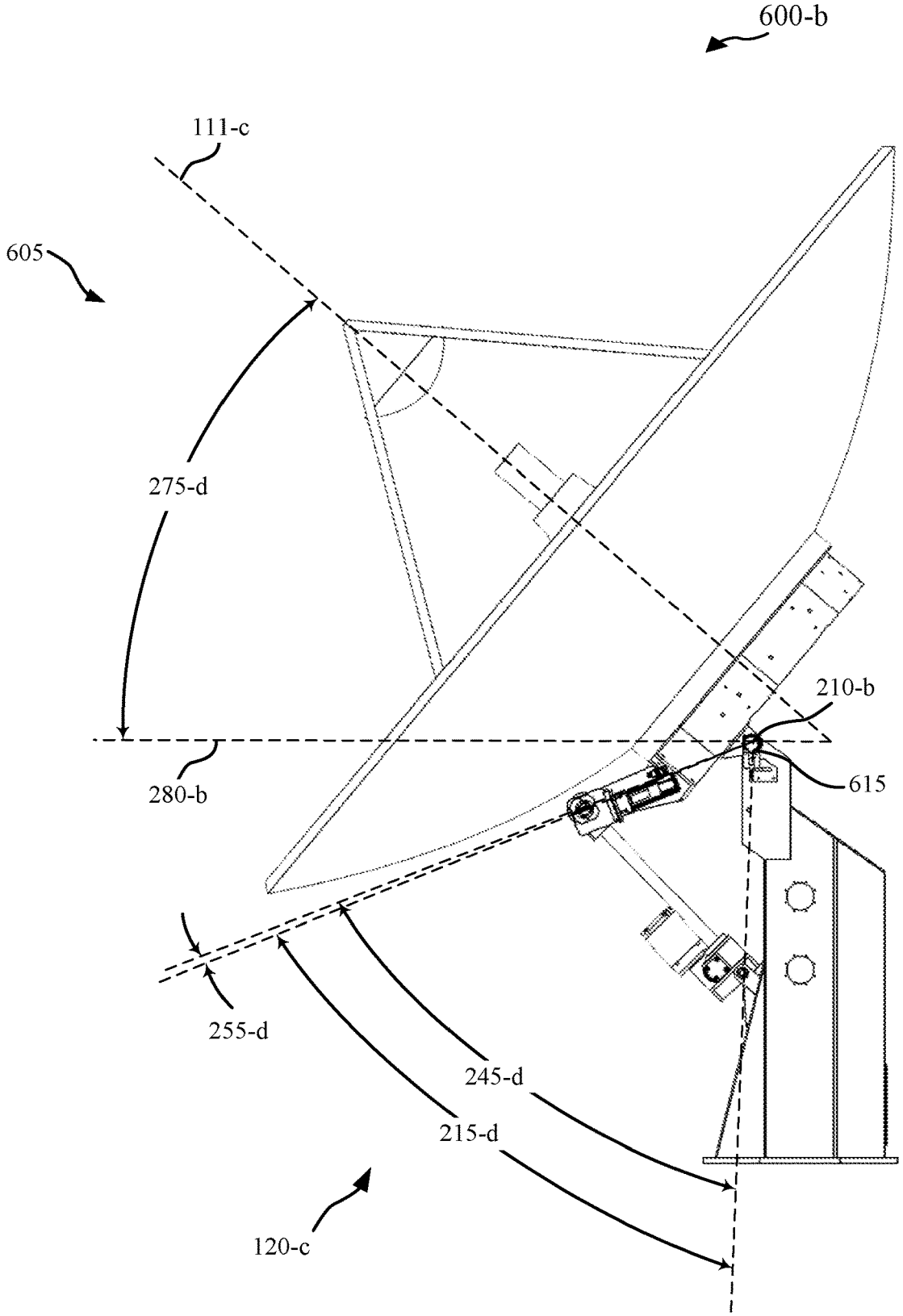

View 600-*b* of FIG. 6B highlights various relevant angles of the antenna system 605. The multiple-assembly positioner 120-*c* adjusts a positioning angle 215-*d*, which is an example of positioning angles 215 described in reference to FIGS. 2A-2C. The positioning angle 215-*d* is a combination of a first portion 245-*d* and a second portion 255-*d*, which can be examples of the first portions 245 and the second portions 255 of the positioning angles 215 described in reference to FIGS. 2A-2C, respectively. As shown in the illustrated example, the second portion 255-*d* of the positioning angle 215-*d* can be considered as a negative value, which subtracts from the first portion 245-*d* of the positioning angle 215-*d* to provide the positioning angle 215-*d*. An adjustment to the positioning angle 215-*d* provides an adjustment to a corresponding antenna angle 275-*d*, which can be an example of corresponding antenna angles 275 described with reference to FIGS. 2A-2C. As shown in the illustrated example, the corresponding antenna angle 275-*d* is measured as an angle between a projection of the boresight 111-*c* on the plane of the view 600-*b* and a horizontal reference 280. Therefore, in the illustrated example the multiple-assembly positioner 120-*c* provides adjustment to the corresponding antenna angle 275-*d* in an elevation direction.

Figure 6C:
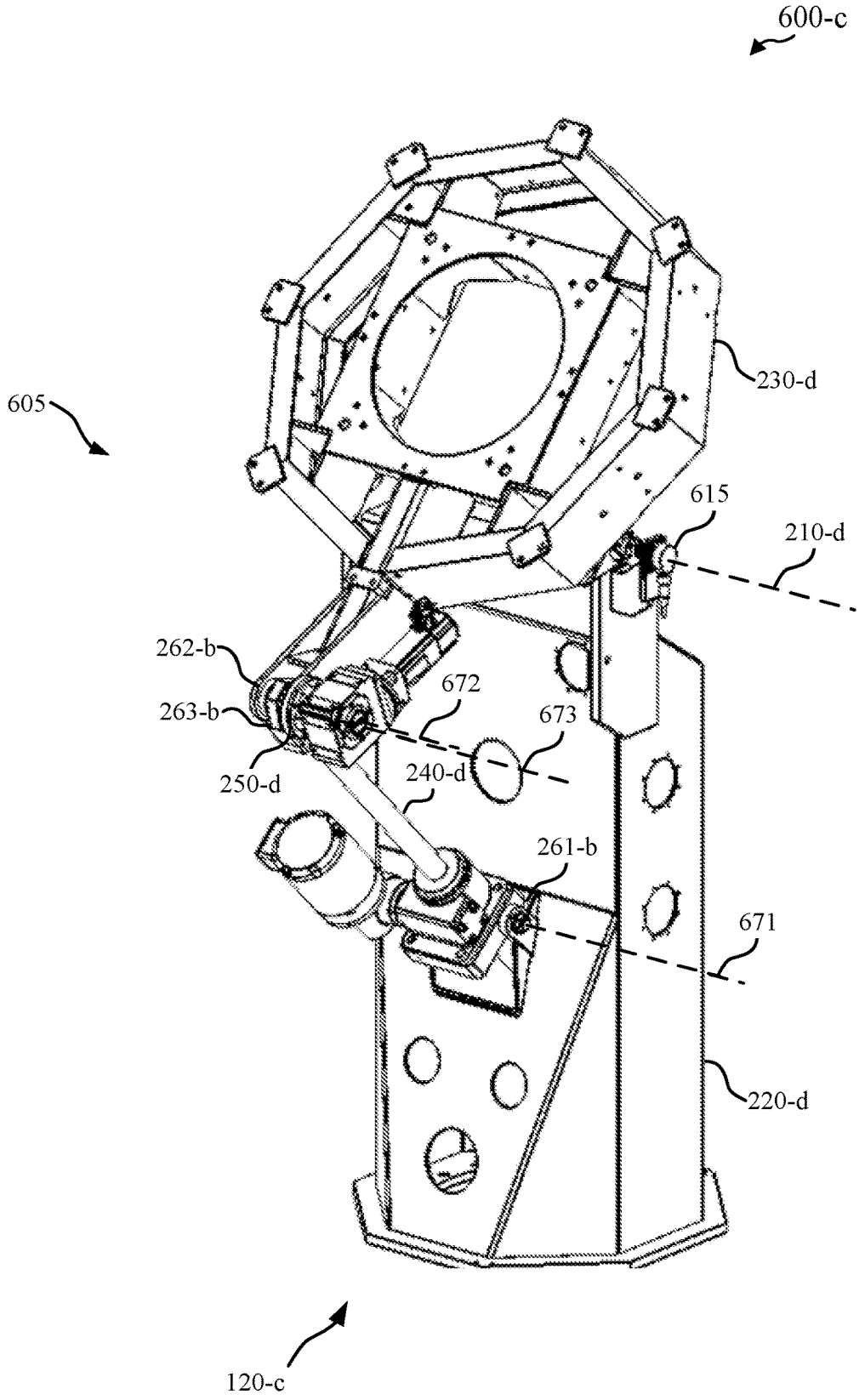

View 600-*c* of FIG. 6C highlights the interconnection of components of the antenna system 605, with the antenna 110-*c* removed for clarity. As shown in the illustrated example, the base structure 220-*d* and the positioning structure 230-*d* are rotatably coupled about a positioning axis 210-*d*. An encoder 615 may provide a signal indicating the current angular value of the positioning angle 215-*d*, which may be translated to the current antenna angle 275-*d* by, for example, adding an angular offset between the positioning angle 215-*d* and the antenna angle 275-*d*. Encoder 615 may be any suitable encoder for determining an angular offset between the base structure 220-*d* and the positioning structure 230-*d*, which may measure an angular offset directly, and/or may make another suitable measurement from which an angular offset can be determined. In various examples, the encoder 615 may be any of a magnetic encoder, an optical encoder, a conductive encoder, a resolver, a synchro, and the like.

The first positioning assembly 240-*d* is rotatably coupled with the base structure 220-*d* at a first coupling location 261-*b*, which provides a rotational degree of freedom about a first coupling axis 671. For instance, the first coupling location 261-*b* can be a first pivot point of the first positioning assembly 240-*d*. The second positioning assembly 250-*d* is rotatably coupled with the positioning structure 230-*d* at a second coupling location 262-*b*, which provides a rotational degree of freedom about a second coupling axis 672. The first positioning assembly 240-*d* is rotatably coupled with the second positioning assembly 250-*d* at a third coupling location 263-*b*, which provides a rotational degree of freedom about a third coupling axis 673. The third coupling location 263-*b* can be a second pivot point of the first positioning assembly 240-*d*.

In the illustrated example, the first positioning assembly 240-*d* can be operated to provide a change in distance between the first coupling location 261-*b* and the third coupling location 263-*b*. For instance, the first positioning assembly 240-*d* can include a jack screw engaged in a threaded portion coupled with the base structure 220-*d*, where a rotation of the jack crew causes the third coupling location 263-*b* to be moved closer to, or farther from the first coupling location 261-*b*. In other examples, the first positioning assembly 240-*d* can include any suitable mechanism for providing a change in distance between the first coupling location 261-*b* and the third coupling location 263-*b*, such as a linear actuator. By changing the distance between the first coupling location 261-*b* and the third coupling location 263-*b*, the first positioning assembly 240-*d* can provide a rotation of the positioning structure 230-*d* about the positioning axis 210-*b*, corresponding to an adjustment to the first portion 245-*d* of the positioning angle 215-*d* as described in reference to FIG. 6B.

The first positioning assembly 240-*d* can be selected based on various criteria in performing specific functions of the multiple-assembly positioner 120-*c*. For instance, in a mode of operation, the first positioning assembly 240-*d* may be actuated to a first position, corresponding to a nominal value of a positioning angle 215-*d* and or corresponding antenna angle 275-*d*. In some examples, it may be desirable for the first positioning assembly 240-*d* to provide a relatively large angular range for the first portion 245-*d* of the positioning angle 215-*d*. In some examples, particularly those in which the first positioning assembly 240-*d* is held at a position for some time period, it may be reasonable to accept a tradeoff towards relatively lower cost and lower precision. In some examples, the first positioning assembly may be held in the first position for a particular time period, either passively (e.g., by way of friction) or actively (e.g., by way of a controllable brake or lock). Therefore, the first positioning assembly 240-*d* can preferably have relatively high friction, as a means of preventing back-driving, where back-driving is a loss of a desired position due a mechanical load, which can be caused by such loading as gravitational loads, wind loads, seismic loads, and the like. Back-driving over a large angular range may be a safety and/or operational hazard, and having high friction in a positioning assembly having a large angular range may improve the response to external loads. In other examples, the first positioning assembly 240-*d* can preferably have an active locking mechanism that holds a position, and therefore a length, of the first positioning assembly 240-*d* during a time period.

In the illustrated example, the second positioning assembly 250-*d* has a fixed distance between the second coupling location 262-*d* and the third coupling location 263-*d*, provided by an shaft with an eccentric portion such as shafts 310 as described in reference to FIG. 3A-3C, 4A-4D, or 5. The second positioning assembly 250-*d* can be operated to provide a rotation of the third coupling axis 673 relative to the second coupling axis 672 in order to provide an adjustment to the second portion 255-*d* of the positioning angle 215-*d*.

Figure 6D:
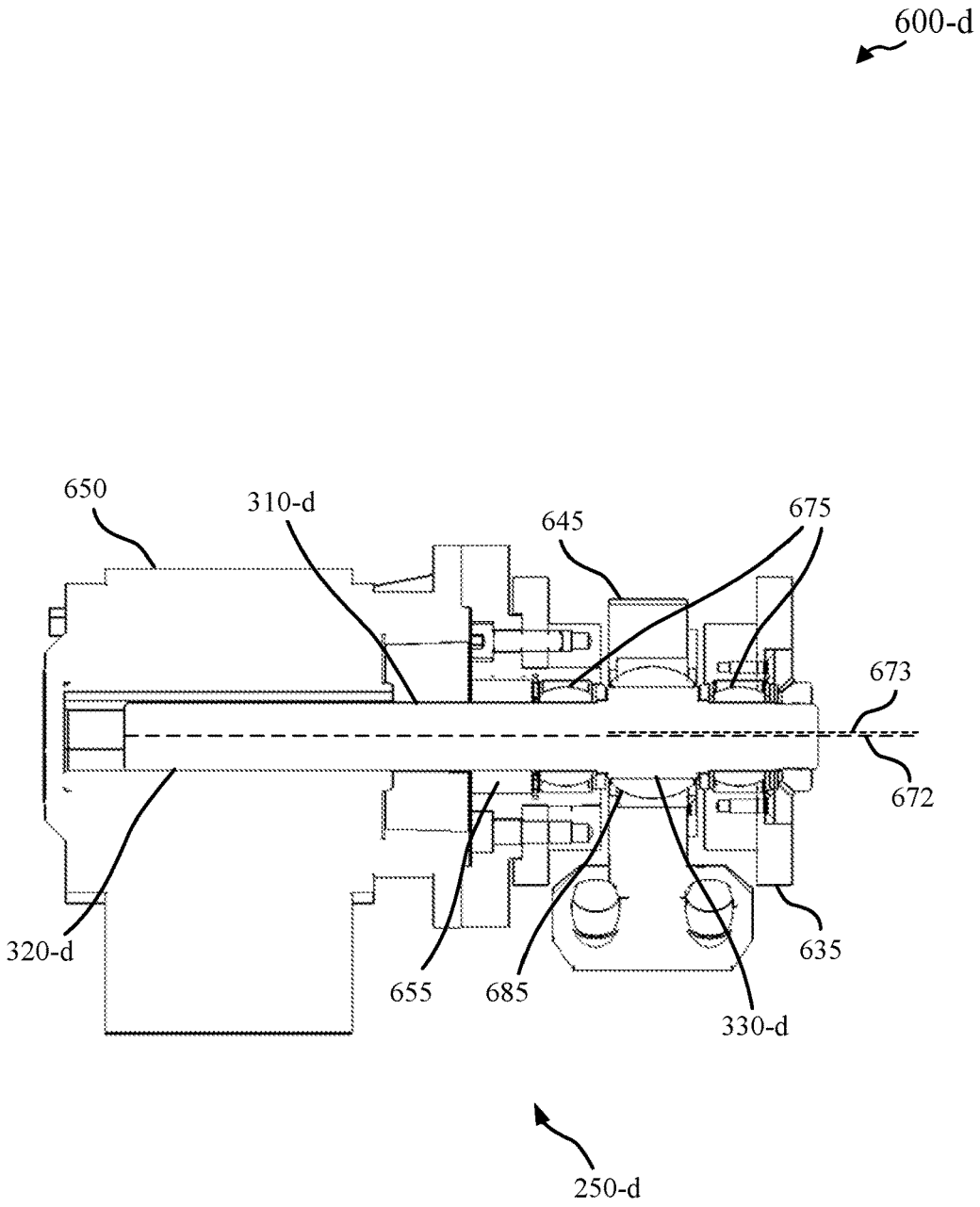

View 600-*d* of FIG. 6D shows a cross-sectional view of second positioning assembly 250-*d* intersecting both the second coupling axis 672 and the third coupling axis 673. In the illustrated example, second positioning assembly 250-*d* includes shaft 310-*d* and drive device 650. The driven portion 320-*d* of shaft 310-*d* is rotatably coupled (e.g., via bearings 675) with a structure 635, which is part of positioning structure 230-*d*. Drive device 650 may be fixedly coupled with the positioning structure 230-*d* via structure 635 and include, for example, an electric motor (e.g., servo motor, etc.), a gear motor, a hydraulic motor, a gearbox, and the like. The eccentric portion 330-*d* of shaft 310-*d* is rotatably coupled (e.g., via bearings 685) to clevis 645, which may be coupled with or a part of the first positioning assembly 240-*d*. That is, in the illustrated example shaft 310-*d* is rotatably coupled with the structure 635 about the second coupling axis 672, and the first positioning assembly 240-*d* is rotatably coupled with the shaft 310-*d* about the third coupling axis 673. The second positioning assembly 250-*d* may include encoder 655, which may provide a signal indicating the current angular position of the shaft 310-*d* (e.g., relative to the drive device 650). Encoder 655 may be any suitable encoder for determining an angular position of the shaft, which may measure an angular position directly, and/or may make another suitable measurement from which an angular position can be determined. In various examples, the encoder 655 may be any of a magnetic encoder, an optical encoder, a conductive encoder, a resolver, a synchro, and the like.

In alternative examples, the driven portion 320-*d* of shaft 310-*d* may be rotatably coupled with the first positioning assembly 240-*d* about the second coupling axis 672, and the structure 635 may be rotatably coupled with the eccentric portion 330-*d* of shaft 310-*d* about the third coupling axis 673. In these examples, the drive device 650 may be fixedly coupled with the first positioning assembly 240-*d*.

In the illustrated example, the eccentric portion 330-*d* of shaft 310-*d* has a circular cross-section and is rotatable coupled with clevis 645 (e.g., via bearing 685). In alternative examples, clevis 645 may be slidably engaged with structure 635 and eccentric portion 330-*d* may have a non-circular cross section (e.g., cam profile, etc.).

The second positioning assembly 250-*d* can be used independently in performing specific functions of the multiple-assembly positioner 120-*c*. For instance, in a mode of operation, while the first positioning assembly 240-*d* is held at a first position for a time period, the second positioning assembly 250-*d* can be actuated during the time period to provide a fine adjustment to the positioning angle 215-*d* and corresponding antenna angle 275-*d*. In some examples, the multiple-assembly positioner 120-*c* may be used to track a geostationary satellite. The position of the geostationary satellite relative to an earth station may have small variations due to lunar and solar gravitational effects or longitudinal drift caused by the asymmetry of the Earth. Thus, the first positioning assembly 240-*d* may provide a first portion 245-*d* of the positioning angle 215-*d* corresponding to a nominal alignment between the antenna boresight 111-*c* and the geostationary satellite. The second positioning assembly 250-*d* may be used to vary a second portion 255-*d* of the positioning angle 215-*d* to provide an adjustment between the boresight 111-*c* and the direction of the geostationary satellite, which may be in response to, for instance, tracking small variations in the geostationary satellite position, compensating for wind and/or seismic loading of the antenna system 605, and/or other movement of the antenna system 605. Additionally or alternatively, the second positioning assembly 250-*d* may be used to periodically (or continuously) scan or nutate the antenna angle 275-*d* over a small angular range (e.g., less than 0.25 degree, etc.) to perform closed-loop tracking (e.g., positioning based on maximizing transmitted and/or received signal strength, etc.) to provide step track or conical scanning. In some examples this may be referred to as "dithering" the second positioning assembly 250-*d* to provide various antenna angles. In some examples, dithering the second positioning assembly can be combined with measuring antenna signal feedback information at the various antenna angles to determine an updated position of the antenna 110 such that, for instance, the antenna boresight 111-*c* can be more directly aligned with a target device 150.

In some examples, the first positioning assembly 240-*d* and second positioning assembly 250-*d* can be adjusted concurrently for positioning the multiple-assembly positioner 120-*c*. For example, it may be determined that, while tracking a target position, the second portion 255-*d* of the positioning angle 215-*d* provided by the second positioning assembly 250-*d* has reached a threshold, which may be related to a maximum offset to the positioning angle 215-*d* that can be provided by the second positioning assembly 250-*d*. The second positioning assembly 250-*d* may be actuated to return to a nominal position (e.g., the second portion of the positioning angle equal to a zero angular offset) and the first positioning assembly 240-*d* may be actuated to position the antenna boresight 111-*c* to point towards a target device. The second positioning assembly 250-*d* may be used to compensate for any backlash in actuation of the first positioning assembly 240-*d*.

Thus, it may be desirable for the second positioning assembly 250-*d* to provide a relatively small angular range of a second portion 255-*d* of the positioning angle 215-*d* with high precision and efficiency. Although in some examples a lower friction may result in the second positioning assembly 250-*d* to be more sensitive to back-driving in the event of drive motor failure, the second positioning assembly 250-*d* may be selected to have a relatively small angular range, so the negative consequences of back-driving can be mitigated.

Figure 7:
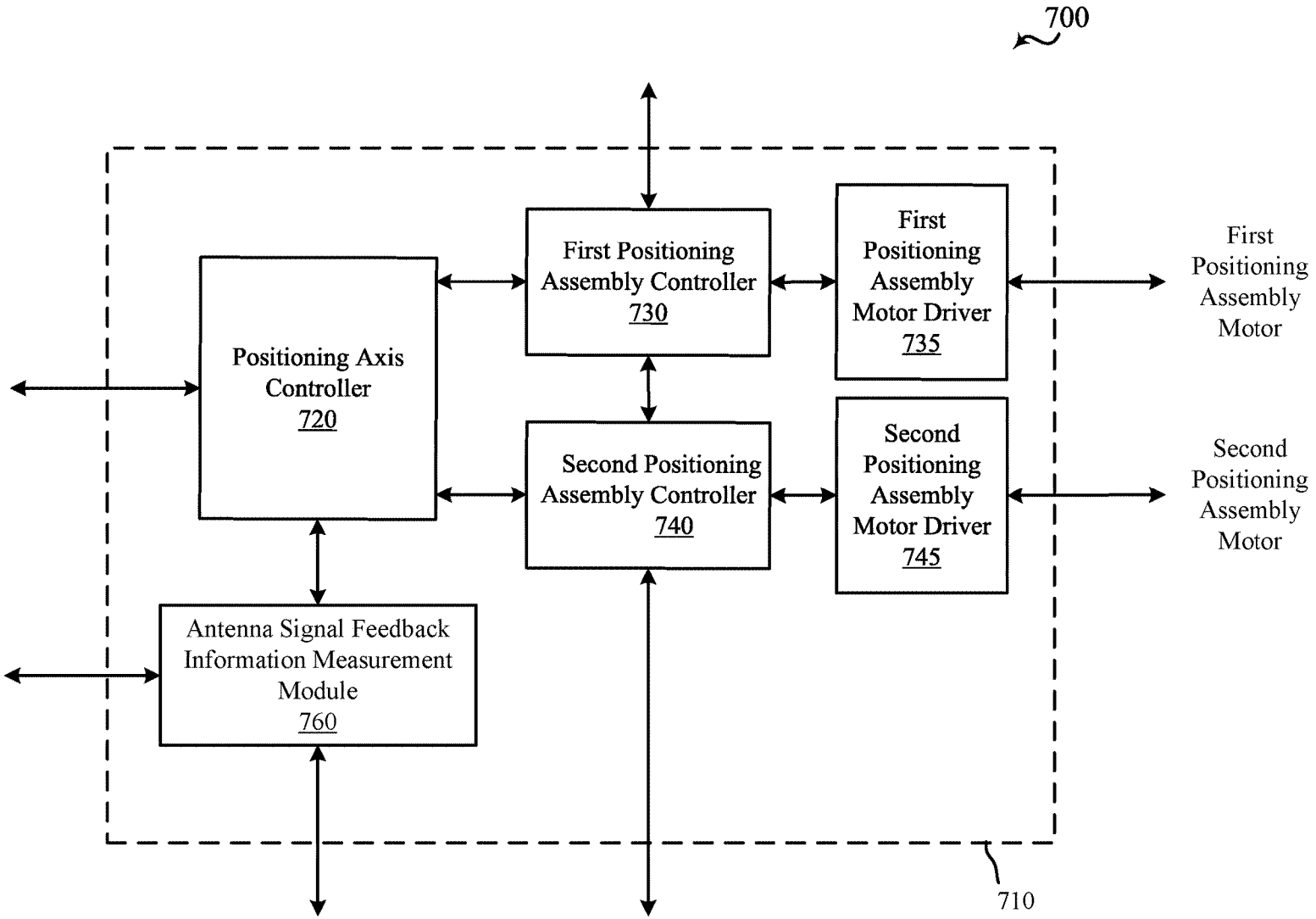
FIG. 7 shows a block diagram illustrating a control system for a multiple-assembly positioner in accordance with various aspects of the present disclosure.

FIG. 7 shows a block diagram 700 illustrating a control system 710 for a multiple-assembly positioner in accordance with various aspects of the present disclosure. Control system 710 may be configured to control a first positioning assembly and a second positioning assembly to control a positioning angle, such as first positioning assemblies 240 and second positioning assemblies 250 described with reference to FIGS. 2-6, to provide a corresponding antenna angle such as antenna angles 275 described with reference to FIGS. 2-6. This control may be to set an initial position after installation or start-up, to compensate for movements of antenna elements relative to a target device, to compensate for movements of the target device itself, to position an antenna element towards a new target device, or to respond to any other control command.

The control system 710 can include a positioning axis controller 720 to define and/or monitor various states of a multiple-assembly positioner, and may provide other high-level functions of the multiple-assembly positioner. States of the multiple-assembly positioner can include initialization states, operational states, and/or fault states, and the positioning axis controller can change between states or maintain a particular state in response to pre-programmed commands and/or signals received from a first positioning assembly controller 730, a second positioning assembly controller 740, and/or signals from outside the control system 710 such as position detectors and/or encoders (e.g., encoders 615 or 655 shown in FIGS. 6A-6D, etc.), sensors, relays, user commands, or any other control signal. The positioning axis controller 720 may also generate various control signals that are delivered to the first positioning assembly controller 730 and/or the second positioning assembly controller 740 in response to pre-programmed instructions and/or signals received from the first positioning assembly controller 730, the second positioning assembly controller 740, and/or signals from components outside the control system 710 such as position detectors and/or encoders, resolvers, synchros, sensors, relays, input devices (e.g., user commands or automated control commands), or other control systems.

The positioning axis controller 720 can receive signals or commands related to a target position and a current position of an antenna boresight and provide commands or signals to the first positioning assembly controller 730 and/or the second positioning assembly controller 740 to position the antenna with the antenna boresight in the angular direction of the target position. For example, the positioning axis controller 720 may provide commands to the first positioning assembly controller 730 for actuating a first positioning assembly to an initial position and hold the first positioning assembly at the initial position. While the first positioning assembly is held in the initial position, the positioning axis controller 720 may provide commands to the second positioning assembly controller 740 to actuate a second positioning assembly to provide a selected antenna positioning (e.g., for actively tracking small angular variations in a target position, etc.). The positioning axis controller 720 may provide commands to the first positioning assembly controller 730 for actuating the first positioning assembly if, for example, a change in a target position is determined to be greater than a first threshold or the second positioning assembly has reached a second threshold, as described in more detail below. Additionally or alternatively, the positioning axis controller 720 may provide commands to the first positioning assembly controller 730 for actuating the first positioning assembly to track a target position if, for example, a failure mode of the second positioning assembly is detected. The positioning axis controller 720 may also control antenna positioning about additional axes. For example, the positioning axis controller 720 may provide commands to the first positioning assembly controller 730 and the second positioning assembly controller 740 for positioning an antenna about an elevation axis using a multiple assembly positioner and the positioning axis controller 720 may also provide commands for positioning about an azimuth axis.

The first positioning assembly controller 730 can generate control signals for a first positioning assembly motor driver 735 based on pre-programmed instructions, or other signals received from the positioning axis controller 720 or the second positioning assembly controller 740, feedback signals from the first positioning assembly motor driver 735, and/or other instructions and/or signals received from outside the control system 710, such as an encoder signal or any other signal. The first positioning assembly controller 730 can deliver commands and/or signals to the first positioning assembly motor driver regarding the magnitude and direction for movement for the first positioning assembly. The first positioning assembly motor driver 735 may include power transistors to generate drive current for the first positioning assembly motor from an electrical power source according to the commands and/or signals to provide a selected position of the first positioning assembly, such as a first portion 245 of a positioning angle 215 as described with reference to FIGS. 2A-2C and 6B.

The second positioning assembly controller 740 can generate control signals for a second positioning assembly motor driver 745 based on pre-programmed instructions, or other signals received from the positioning axis controller 720 or the first positioning assembly controller 730, feedback signals from the second positioning assembly motor driver 745, and/or other instructions and/or signals received from outside the control system 710, such as an encoder signal (e.g., an encoder signal from encoder 655) or any other signal. The second positioning assembly controller 740 can deliver commands and/or signals to the second positioning assembly motor driver 745 regarding the magnitude and direction for movement for the second positioning assembly. The second positioning assembly motor driver 745 may include power transistors to generate drive current for the second positioning assembly motor from an electrical power source according to the commands and/or signals to provide a selected position of the second positioning assembly, such as a second portion 255 of a positioning angle 215 as described with reference to FIGS. 2A-2C and 6B.

In some examples, the positioning axis controller 720, the first positioning assembly controller 730, and the second positioning assembly controller 740 may be separate devices, or separate portions of a unitary control system 710. In other examples, the positioning axis controller 720, the first positioning assembly controller 730, and the second positioning assembly controller 740 may be integrated into the same component or module.

The control system 710 can provide compensation for the particular position of one or both of a first positioning assembly and a second positioning assembly. For instance, a controller gain schedule, which can include controller gains, offsets, deadbands, multipliers, and the like, can be selected and/or adjusted based at least in part on the position of the first positioning assembly and/or a second positioning assembly. As one example, it may be desirable for the second positioning assembly controller 740 to have a first gain schedule for a first position of a second positioning assembly (e.g., the first position of the second positioning assembly 250-*b* shown in view 400-*a*), and to have a second, different gain schedule for a second position of the second positioning assembly 250-*b* (e.g., the second position of the second positioning assembly 250-*b* shown in view 400-*b*). This may be, for instance, related to the torque required to counteract an applied force being a function of the angular position of the second positioning assembly. By applying a first gain schedule for the first position, and a second, different gain schedule for the second position, the control stability of a multiple-assembly positioner can be improved. In other examples, it may be desirable to have different gain schedules for the second positioning assembly controller 740 as a function of a state of a first positioning assembly, or vice-versa. For instance, a change in length and/or angular position of a first positioning assembly 240 may cause the actuation of a second positioning assembly 250 to have a different effect on the positioning angle 215. The difference in effect of the second positioning assembly on the positioning angle based on the length of the first positioning assembly can be compensated for by selecting and/or adjusting a gain schedule accordingly. The described adjustments to gain scheduling can be provided by the positioning axis controller 720, and/or one or more of the first positioning assembly controller 730 or the second positioning assembly controller 740.

The control system 710 may also include an antenna signal feedback information measurement module 760, which may be configured to measure characteristics of antenna signal at various positions including identifying and/or estimating signal strength, interference, lost data packets, and the like. In some examples the measured antenna signal feedback information can be sent to the positioning axis controller 720 or another controller and/or processor outside the control system 710. Additionally or alternatively the measured signal feedback information can be used within the antenna signal feedback information measurement module 760.

Figure 8:
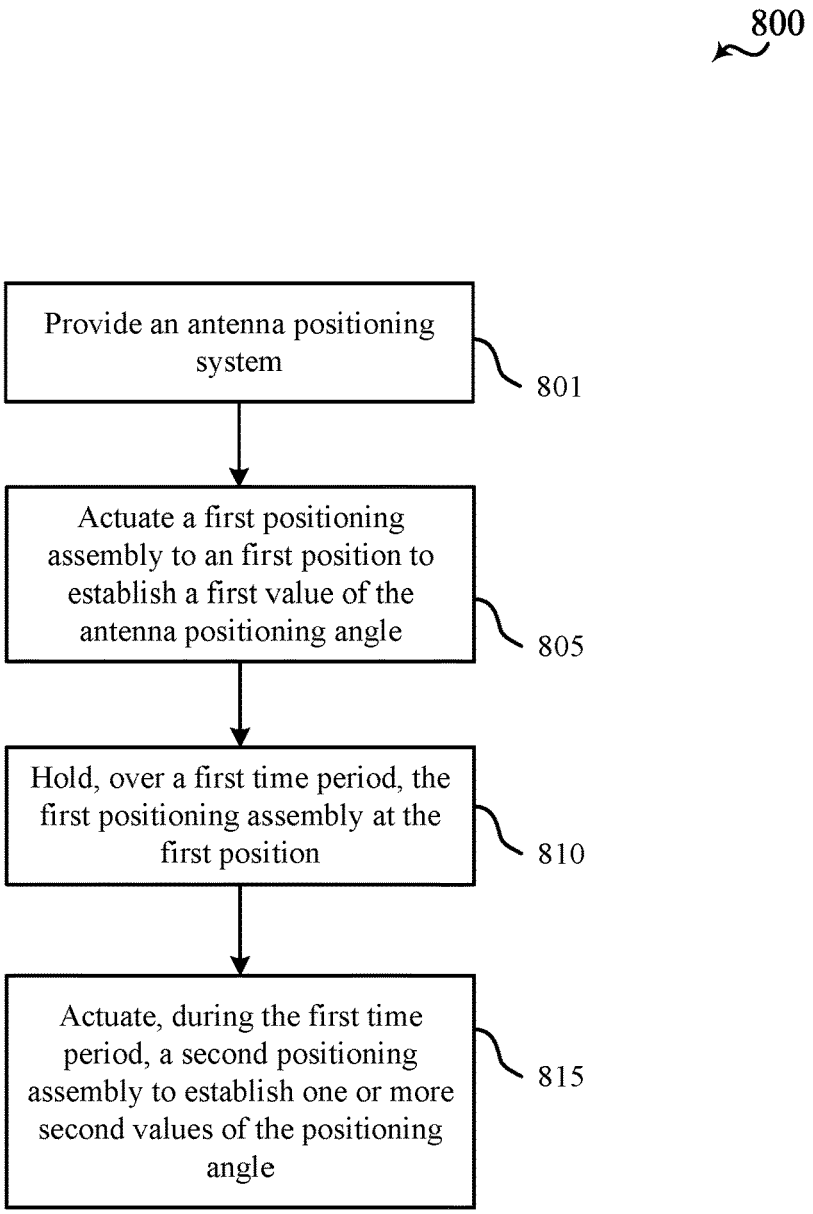
FIG. 8 shows a flow chart of an example method for positioning an antenna, in accordance with various aspects of the present disclosure.

The control system 710, including the positioning axis controller 720, first positioning assembly controller 730, first positioning assembly motor driver 735, second positioning assembly controller 740, second positioning assembly motor driver 745, and the antenna signal feedback information measurement module 760 may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, multiple microprocessors, one or more microprocessors in conjunction with a DSP core, or any other such configuration FIG. 8 shows a flow chart of an example method 800 for positioning an antenna, in accordance with various aspects of the present disclosure. The method 800 may be described below with reference to aspects of one or more of the multiple-assembly antenna positioners 120 described with reference to FIGS. 1-7. In some examples, an apparatus for positioning an antenna using a multiple-assembly antenna positioner 120 may execute one or more instructions to perform the functions described below. Additionally or alternatively, the apparatus for positioning an antenna may perform one or more of the functions described below using special-purpose hardware.

At block 801, the method 800 may include providing an antenna positioning system. The antenna positioning system may include a base structure, and a positioning structure rotatably coupled to the base structure about a positioning axis to provide a positioning angle between the positioning structure and the base structure. The antenna positioning may further include a first positioning assembly coupled with one of the base structure or the positioning structure, the first positioning assembly providing a first adjustment to the positioning angle, the first position of the first positioning assembly corresponding to a first value of the positioning angle. The first positioning assembly may be, for example, one or more of the first positioning assemblies 240 of FIGS. 2A-2C, 4A-4B, and/or 6A-6C. The antenna positioning system may further include a second positioning assembly coupled between the first positioning assembly and the other of the base structure or the positioning structure, the actuation of the second positioning assembly providing a second adjustment to the positioning angle over a second angular range. The second positioning assembly may be, for example, any of the second positioning assemblies 250 of FIGS. 2A-2C, 4A-4B, and/or 6A-6C. In some examples, the second positioning assembly can include, for instance, a shaft with an eccentric portion, such as shafts 310 described in reference to FIG. 3A-3C, 4A-4D, 5, or 6D.

At block 805, the method 800 may include actuating the first positioning assembly to a first position to establish a first value of the positioning angle. In some examples, certain steps of block 805 can be provided by portions of a control system 710 as described with reference to FIG. 7, such as the positioning axis controller 720, the first positioning assembly controller 730, and/or the first positioning assembly motor driver 735.

At block 810, the method 800 may include holding, over a first time period, the first positioning assembly at the first position of the first positioning assembly. As previously described, the holding at a position can be provided by passive means, such as a degree of friction in the first positioning assembly, or can be the result of an active device such as a brake or lock. In some examples, certain steps of block 810 can be provided by portions of a control system 710 as described with reference to FIG. 7, such as the positioning axis controller 720, the first positioning assembly controller 730, and/or the first positioning assembly motor driver 735.

At block 815, the method 800 may include actuating a second positioning assembly during the first time period to establish one or more second values of the positioning angle. Actuating the second positioning assembly can, for instance, include providing a driven rotation to the shaft. Block 815 may include actively tracking small variations in movement of a target position. In some examples, certain steps of block 815 can be provided by portions of a control system 710 as described with reference to FIG. 7, such as the positioning axis controller 720, the second positioning assembly controller 740, and/or the second positioning assembly motor driver 745.

Figure 9:
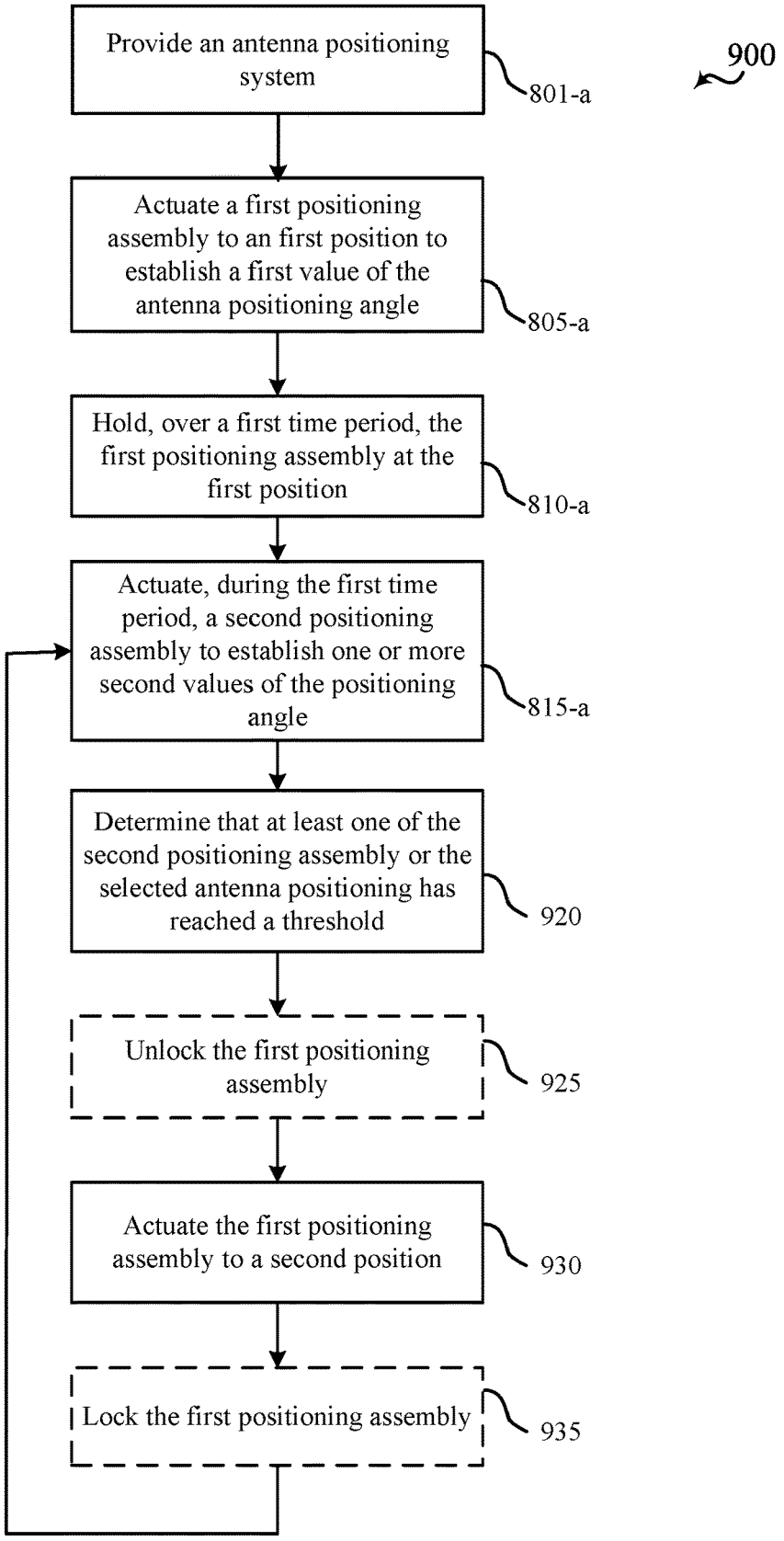
FIG. 9 shows a flow chart of an example method for positioning an antenna, in accordance with various aspects of the present disclosure.

FIG. 9 shows a flow chart of an example method 900 for positioning an antenna, in accordance with various aspects of the present disclosure. The method 900 may be described below with reference to aspects of one or more of the multiple-assembly antenna positioners 120 described with reference to FIGS. 1-7. In some examples, an apparatus for positioning an antenna using a multiple-assembly antenna positioner 120 may execute one or more instructions to perform the functions described below. Additionally or alternatively, the apparatus for positioning an antenna may perform one or more of the functions described below using special-purpose hardware.

At block 801-*a*, the method 900 may include providing an antenna positioning system. Block 801-*a* may correspond, for example, to block 801 of method 800 described above.

At block 805-*a*, the method 900 may include actuating a first positioning assembly to a first position to establish a first value of the positioning angle. Block 805-*a* may correspond, for example, to block 805 of method 800 described above.

At block 810-*a*, the method 900 may include holding, over a first time period, the first positioning assembly at the first position of the first positioning assembly. Block 810-*a* may correspond, for example, to block 810 of method 800 described above.

At block 815-*a*, the method 900 may include actuating a second positioning assembly during the first time period to establish one or more second values of the positioning angle. Block 815-*a* may correspond, for example, to block 815 of method 800 described above.

At block 920, the method 900 may include determining that at least one of the second positioning assembly or the selected antenna positioning has reached a threshold. The second positioning assembly threshold may, for instance, relate to an angle of rotation of a shaft with an eccentric portion. For example, the second positioning assembly threshold may be related to a maximum offset (e.g., maximum positive angle or maximum negative angle) to the antenna positioning angle provided by the second positioning assembly. More generally, the threshold can be related to the range of adjustment to the positioning angle that can be provided by the second positioning assembly. In some examples, it may be desirable to operate relatively near the middle of the angular range of the adjustment to a positioning angle provided by a second positioning assembly in order to maximize the available positive/negative actuation and limit the amount of actuation of the first positioning assembly. Therefore, if the second positioning assembly has reached or is near either end of the angular range and/or the range of adjustment to the positioning angle that can be provided by the second positioning assembly, the method 920 may determine that the second positioning assembly has reached a threshold.

The threshold value may be related to a difference between a target value of the one or more second values of the positioning angle and a current value of the one or more second values of the positioning angle. For instance, a target value of the positioning angle may change when, for instance, a target device has moved, the antenna system changes to a different target device, and/or the antenna system itself has moved. A threshold may be reached when a change in a target positioning angle is relatively far from a current positioning angle (e.g., greater than the angular range of the second positioning assembly at the current position of the first positioning assembly). In some examples, certain steps of block 920 can be provided by portions of a control system 710 as described with reference to FIG. 7, such as the positioning axis controller 720, the first positioning assembly controller 730, and/or the second positioning assembly controller 740.

At block 925, the method 900 may optionally include, where applicable, unlocking the first positioning assembly. This step may be required, for instance, where a first positioning assembly includes an active locking element as previously described. In some examples, certain steps of block 925 can be provided by portions of a control system 710 as described with reference to FIG. 7, such as the positioning axis controller 720, the first positioning assembly controller 730, and/or the first positioning assembly motor driver 735.

At block 930, the method 900 may include actuating the first positioning assembly to a second position. The second position may correspond with, for instance, a different location of a target device, the location of a different target device, and/or a compensation for movement of the antenna system. In some examples, the block 930 may include adjusting the second positioning assembly to a nominal position (e.g., a zero angular offset provided by the second positioning assembly) concurrently with actuating the first positioning assembly. In some examples, certain steps of block 930 can be provided by portions of a control system 710 as described with reference to FIG. 7, such as the positioning axis controller 720, the first positioning assembly controller 730, and/or the first positioning assembly motor driver 735.

At block 935, the method 900 may optionally include, where applicable, locking the first positioning assembly. This step may be available, for instance, where a first positioning assembly includes an active locking element as previously described. In some examples, certain steps of block 935 can be provided by portions of a control system 710 as described with reference to FIG. 7, such as the positioning axis controller 720, the first positioning assembly controller 730, and/or the first positioning assembly motor driver 735.

Following the described steps, the method 900 may optionally return to block 815-*a*, wherein the second positioning assembly is actuated to provide a selected antenna positioning.

Figure 10:
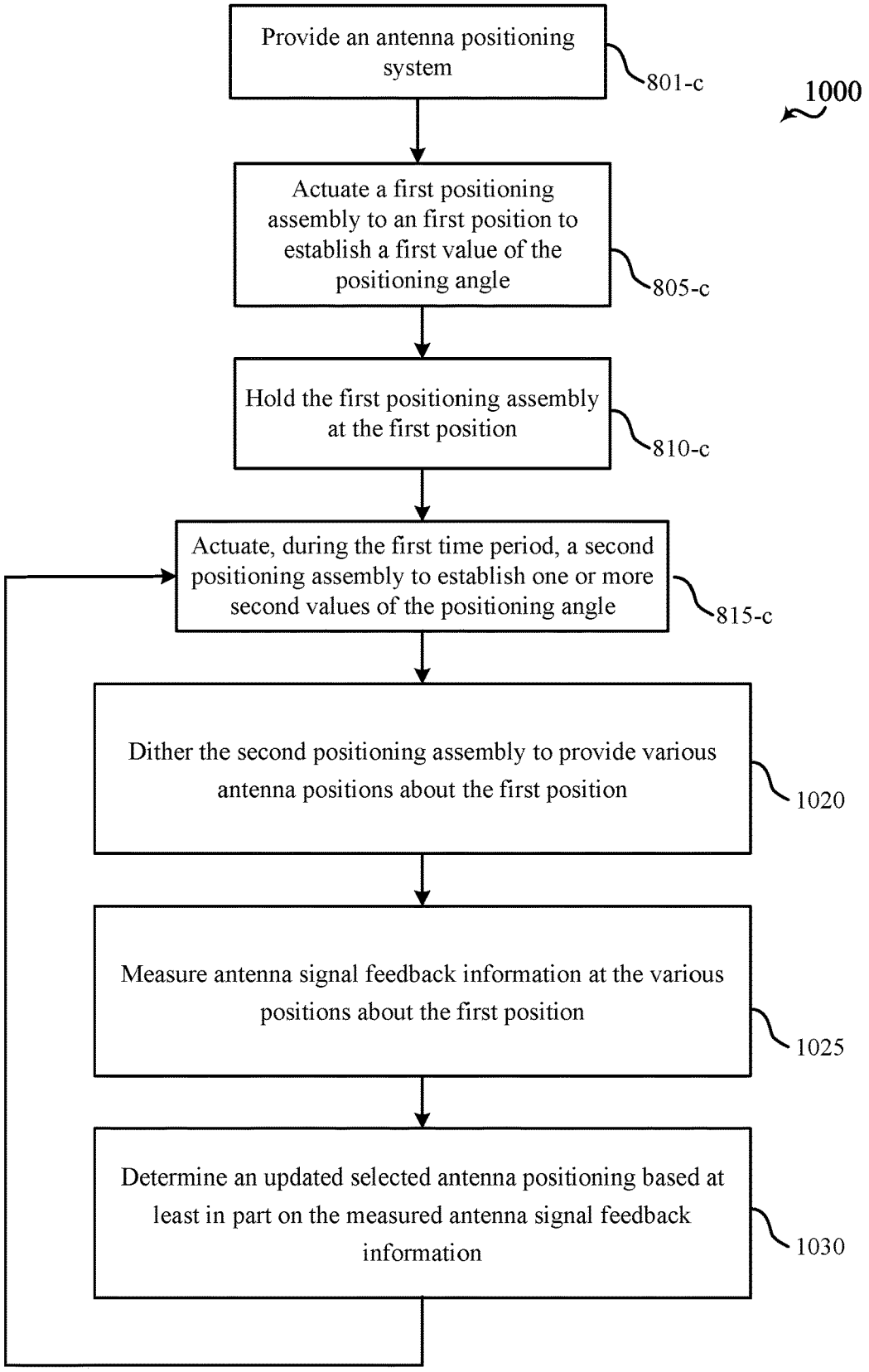
FIG. 10 shows a flow chart of an example method for positioning an antenna, in accordance with various aspects of the present disclosure.

FIG. 10 shows a flow chart of an example method 1000 for positioning an antenna, in accordance with various aspects of the present disclosure. The method 1000 may be described below with reference to aspects of one or more of the multiple-assembly antenna positioners 120 described with reference to FIGS. 1-7. In some examples, an apparatus for positioning an antenna using a multiple-assembly antenna positioner 120 may execute one or more instructions to perform the functions described below. Additionally or alternatively, the apparatus for positioning an antenna may perform one or more of the functions described below using special-purpose hardware.

At block 801-*c*, the method 1000 may include providing an antenna positioning system. Block 801-*c* may correspond, for example, to block 801 of method 800 described above.

At block 805-*c*, the method 1000 may include actuating a first positioning assembly to a first position to establish a first value of the positioning angle. Block 805-*c* may correspond, for example, to block 805 of method 800 described above.

At block 810-*c*, the method 1000 may include holding, over a first time period, the first positioning assembly at the first position of the first positioning assembly. Block 810-*c* may correspond, for example, to block 810 of method 800 described above.

At block 815-*c*, the method 1000 may include actuating a second positioning assembly during the first time period to establish one or more second values of the positioning angle. Block 815-*c* may correspond, for example, to block 815 of method 800 described above.

At block 1020, the method 1000 may include dithering the second positioning assembly to provide various antenna positions about the initial antenna positioning angle. Each of the various antenna positions may, for instance, be either a positive or negative offset from the selected antenna positioning. In some examples, certain steps of block 1020 can be provided by portions of a control system 710 as described with reference to FIG. 7, such as the positioning axis controller 720, the second positioning assembly controller 740, and/or the second positioning assembly motor driver 745.

At block 1025, the method 1000 may include measuring antenna signal feedback information at the various positions about the first position. Measuring antenna signal feedback information can include any means of characterizing the antenna signals at the various positions about the first position, including identifying and/or estimating signal strength, interference, lost data packets, and the like. In some examples, certain steps of block 1025 can be provided by portions of a control system 710 as described with reference to FIG. 7, such as the antenna signal feedback information measurement module 760.

At block 1030, the method 1000 may include determining an updated selected antenna positioning based at least in part on antenna signal feedback information at the first and second scanning positions. In some examples, certain steps of block 1030 can be provided by portions of a control system 710 as described with reference to FIG. 7, such as the positioning axis controller 720, the antenna signal feedback information measurement module 760, the first positioning assembly controller 730, and/or the second positioning assembly controller 740.

Following the described steps, the method 1000 may optionally return to block 815-*c*, wherein the second positioning assembly is actuated to provide the updated selected antenna positioning.

Thus, the methods 800, 900, and 1000 may provide for antenna positioning in systems employing a multiple-assembly antenna positioner. It should be noted that the methods 800, 900, and 1000 discuss exemplary implementations and that the operations of the methods 800, 900, and 1000 may be rearranged or otherwise modified such that other implementations are possible. For example, aspects from two or more of the methods 800, 900, and 1000 may be combined.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

The foregoing description and claims may refer to elements or features as being "connected" or "coupled" together. As used herein, unless expressly stated otherwise, "connected" means that one element/feature is directly or indirectly connected to another element/feature. Likewise, unless expressly stated otherwise, "coupled" means that one element/feature is directly or indirectly coupled with another element/feature.

As used herein, unless expressly stated otherwise, "rotatably coupled" refers to a coupling between objects which have a positional constraint between them at a coupling location, and have at least one rotational degree of freedom between them, where the at least one rotational degree of freedom is about at least one axis that passes through the coupling location. For instance, objects may be rotatably coupled by any of a ball bearing, a roller bearing, a journal bearing, a bushing, a spherical bearing, a ball and socket joint, and the like. A description of objects being "rotatably coupled" does not preclude a linear degree of freedom between the objects. For instance, rotatably coupled objects may be coupled by a cylindrical journal bearing that provides a rotational degree of freedom about the axis of the cylinder, as well as a linear degree of freedom along the axis of the cylinder. In such an example, the positional constraint between the objects would be in a radial direction from the axis of the cylinder.

As used herein, unless expressly stated otherwise, "fixedly coupled" refers a coupling between objects which have neither a linear degree of freedom nor a rotational degree of freedom between them. For instance, objects may be fixedly coupled by any one or more of a screw, a bolt, a clamp, a magnet, and/or by a process such as welding, brazing, soldering, gluing, fusing, and the like. A description of objects being "fixedly coupled" does not entirely preclude movement between the objects. For instance, objects that are fixedly coupled may have looseness and/or wear at a location of coupling which permits some degree of movement between objects. Furthermore, objects that are fixedly coupled may experience a degree of movement between them as a result of compliance within or between the objects. In addition, two objects that are fixedly coupled need not be in direct contact, and may instead have other components that are fixedly coupled between the two objects.

Thus, although the various schematics shown in the Figures depict example arrangements of elements and components, additional intervening elements, devices, features, or components may be present in an actual embodiment (assuming that the functionality of the depicted circuits is not adversely affected).

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The functions described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. An apparatus comprising:

a base structure;

an antenna having an antenna boresight;

a first positioning assembly configured to provide a first adjustment to an antenna angle measured between the antenna boresight and the base structure about an elevation axis; and a second positioning assembly configured to provide a second adjustment to the antenna angle about the elevation axis, the second positioning assembly comprising a shaft with an eccentric portion having an eccentric axis that is parallel to the elevation axis, and the second positioning assembly comprising a motor coupled to the shaft, wherein the motor providing a rotation of the shaft about a first axis of the shaft provides the second adjustment to the antenna angle about the elevation axis.

2. The apparatus of claim 1, wherein the first adjustment to the antenna angle about the elevation axis has a first angular range, and the second adjustment to the antenna angle measured between the antenna boresight and the base structure about the elevation axis has a second angular range that is less than the first angular range.

3. The apparatus of claim 1, further comprising:

a control system configured to control actuation of at least one of the first positioning assembly or the second positioning assembly.

4. The apparatus of claim 3, wherein the control system is configured to hold the first positioning assembly at a position during a time period and actuate the second positioning assembly during the time period.

5. The apparatus of claim 3, wherein the control system is configured to actuate the first positioning assembly and the second positioning assembly concurrently.

6. The apparatus of claim 3, wherein the control system is configured to:

determine that a position of the second positioning assembly has reached a threshold;

actuate the second positioning assembly to a nominal position; and actuate the first positioning assembly to direct the antenna boresight towards a target.

7. The apparatus of claim 3, wherein the control system comprises different controller gain schedules associated with different positions of the first positioning assembly, different positions of the second positioning assembly, or both.

8. The apparatus of claim 1, wherein the eccentric portion of the shaft has a circular cross-section about the eccentric axis, the eccentric axis being parallel to the first axis of the shaft and separated from the first axis of the shaft by an eccentricity distance.

9. The apparatus of claim 1, further comprising:

a third positioning assembly configured to provide an adjustment to a second antenna angle measured between the antenna boresight and the base structure about a second axis that is non-parallel with the elevation axis.

10. The apparatus of claim 1, wherein the first positioning assembly comprises:

a linear actuator to provide the first adjustment to the antenna angle measured between the antenna boresight and the base structure about the elevation axis.

11. The apparatus of claim 1, wherein the first positioning assembly comprises at least one of a turnbuckle, a linear rack gear, a hydraulic cylinder, a worm gear, a jack screw, or a ball screw.

12. The apparatus of claim 1, wherein the first positioning assembly comprises a linear motor.

13. The apparatus of claim 1, wherein the first positioning assembly comprises a controllable brake or locking mechanism operable to hold the first positioning assembly while providing the second adjustment to the antenna angle about the elevation axis.

14. The apparatus of claim 1, wherein the first positioning assembly is configured with a level of friction for holding the first positioning assembly at a position while providing the second adjustment to the antenna angle about the elevation axis.

15. The apparatus of claim 1, wherein the first positioning assembly is rotatably coupled to the base structure.

16. The apparatus of claim 1, wherein:

the first positioning assembly is configured to provide the first adjustment to the antenna angle based at least in part on providing an adjustment to a first angle measured between the base structure and a coupling location; and the second positioning assembly is configured to provide the second adjustment to the antenna angle based at least in part on providing an adjustment to a second angle measured between the coupling location and the antenna boresight.

17. The apparatus of claim 1, wherein:

the first positioning assembly is configured to provide the first adjustment to the antenna angle based at least in part on providing an adjustment to a distance between the base structure and a coupling location; and the second positioning assembly is configured to provide the second adjustment to the antenna angle based at least in part on providing an adjustment to an angle between the coupling location and a second coupling location.

18. The apparatus of claim 1, wherein:

the first positioning assembly is configured to provide the first adjustment to the antenna angle in a plane perpendicular to the elevation axis; and the second positioning assembly configured to provide the second adjustment to the antenna angle in the plane perpendicular to the elevation axis.

* * * * *